US010401763B2

(12) United States Patent
Kaneko et al.

(10) Patent No.: US 10,401,763 B2
(45) Date of Patent: Sep. 3, 2019

(54) IMAGE FORMING APPARATUS

(71) Applicant: Ricoh Company, Ltd., Tokyo (JP)

(72) Inventors: Satoshi Kaneko, Kanagawa (JP); Shuji Hirai, Tokyo (JP); Yuuichiroh Uematsu, Kanagawa (JP); Terumichi Ochi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 38 days.

(21) Appl. No.: 15/713,838

(22) Filed: Sep. 25, 2017

(65) Prior Publication Data

US 2018/0136593 A1 May 17, 2018

(30) Foreign Application Priority Data

Nov. 14, 2016 (JP) ..... 2016-221393

(51) Int. Cl.
*G03G 15/16* (2006.01)
*G03G 15/00* (2006.01)
(Continued)

(52) U.S. Cl.
CPC ..... *G03G 15/1615* (2013.01); *G03G 15/065* (2013.01); *G03G 15/5025* (2013.01); *G03G 15/5041* (2013.01); *G03G 15/5058* (2013.01); *G03G 21/1647* (2013.01); *G03G 13/14* (2013.01); *G03G 15/011* (2013.01); *G03G 15/5008* (2013.01); *G03G 21/1676* (2013.01);
(Continued)

(58) Field of Classification Search
CPC ..... G03G 15/16
USPC ..... 399/130
See application file for complete search history.

(56) References Cited

U.S. PATENT DOCUMENTS

2012/0099165 A1 4/2012 Omori et al.
2014/0169814 A1 6/2014 Uematsu et al.
(Continued)

FOREIGN PATENT DOCUMENTS

JP 2007-140402 6/2007
JP 2012-088522 5/2012
(Continued)

OTHER PUBLICATIONS

U.S. Appl. No. 15/447,696, filed Mar. 2, 2017.

*Primary Examiner* — Quana Grainger
(74) *Attorney, Agent, or Firm* — Xsensus LLP

(57) ABSTRACT

An image forming apparatus includes an image forming unit and a controller. The image forming unit includes a latent image bearer, a charger to charge the latent image bearer, an exposure device to expose a latent image on the surface of the latent image bearer, and a developing device to develop the latent image with a developer. The controller executes an image forming process, a first fluctuation control that cyclically changes a developing bias supplied to the developing device based on predetermined first pattern data, and a second fluctuation control that cyclically changes a charging bias supplied to the charger based on predetermined second pattern data, in parallel. The controller executes a determination process to determine whether the controller executes the first fluctuation control. When the controller determines not to execute the first fluctuation control, the controller determines not to execute the second fluctuation control, too.

22 Claims, 17 Drawing Sheets

(51) Int. Cl.

| | |
|---|---|
| ***G03G 21/16*** | (2006.01) |
| ***G03G 15/06*** | (2006.01) |
| *G03G 13/14* | (2006.01) |
| *G03G 21/20* | (2006.01) |
| *G03G 15/01* | (2006.01) |

(52) U.S. Cl.
CPC . *G03G 21/203* (2013.01); *G03G 2215/00042* (2013.01); *G03G 2221/1657* (2013.01)

(56) References Cited

U.S. PATENT DOCUMENTS

| | | | | |
|---|---|---|---|---|
| 2014/0301748 | A1* | 10/2014 | Suzuki | G03G 15/5025 399/49 |
| 2016/0124367 | A1* | 5/2016 | Kaneko | G03G 15/065 399/53 |
| 2016/0187807 | A1 | 6/2016 | Hirai et al. | |
| 2016/0223934 | A1 | 8/2016 | Watanabe et al. | |
| 2016/0299452 | A1 | 10/2016 | Kaneko et al. | |
| 2016/0334734 | A1 | 11/2016 | Kaneko et al. | |

FOREIGN PATENT DOCUMENTS

| | | |
|---|---|---|
| JP | 2014-119713 | 6/2014 |
| JP | 2016-040634 | 3/2016 |

* cited by examiner

| FIG. 7A |
| --- |
| FIG. 7B |

IMAGE FORMING APPARATUS

CROSS-REFERENCE TO RELATED APPLICATION

This patent application is based on and claims priority pursuant to 35 U.S.C. § 119 to Japanese Patent Application No. 2016-221393, filed on Nov. 14, 2016 in the Japanese Patent Office, the entire disclosure of which is hereby incorporated by reference herein.

BACKGROUND

Technical Field

Embodiments of the present disclosure generally relate to an image forming apparatus, such as a copier, a printer, a facsimile machine, or a multifunction peripheral having at least two of copying, printing, facsimile transmission, plotting, and scanning capabilities.

Background Art

Conventionally, there are image forming apparatuses that include a charging device to charge a surface of a latent image bearer, an exposure device to expose a latent image to the surface of the latent image bearer after charging, and a developing device to develop the latent image. The charging device, the exposure device, and the developing device form a toner image as an image forming device. The image forming device generally includes a controller. The controller controls the image forming device to keep image quality stable.

In contemporary image forming apparatuses, the controller executes a determination process that determines whether the controller cyclically changes a developing bias supplied to the developing device based on predetermined pattern data to prevent an image density fluctuation caused by a cyclic fluctuation of a developing gap.

SUMMARY

This specification describes an improved image forming apparatus. In one illustrative embodiment, the image forming apparatus includes an image forming unit and a controller. The image forming unit includes a latent image bearer to bear a latent image, a charger to charge a surface of the latent image bearer, an exposure device to expose the latent image on the charged surface of the latent image bearer, and a developing device to develop the latent image with a developer. The controller executes an image forming process by the image forming unit, a first fluctuation control that cyclically changes a developing bias supplied to the developing device based on predetermined first pattern data in parallel with the image forming process, and a second fluctuation control that cyclically changes a charging bias supplied to the charger based on predetermined second pattern data in parallel with the image forming process. The controller executes a determination process to determine whether the controller executes the first fluctuation control and the image forming process in parallel. The controller determines not to execute the second fluctuation control and the image forming process in parallel when the controller determines not to execute the first fluctuation control and the image forming process in parallel.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

DETAILED DESCRIPTION

Figure 1:
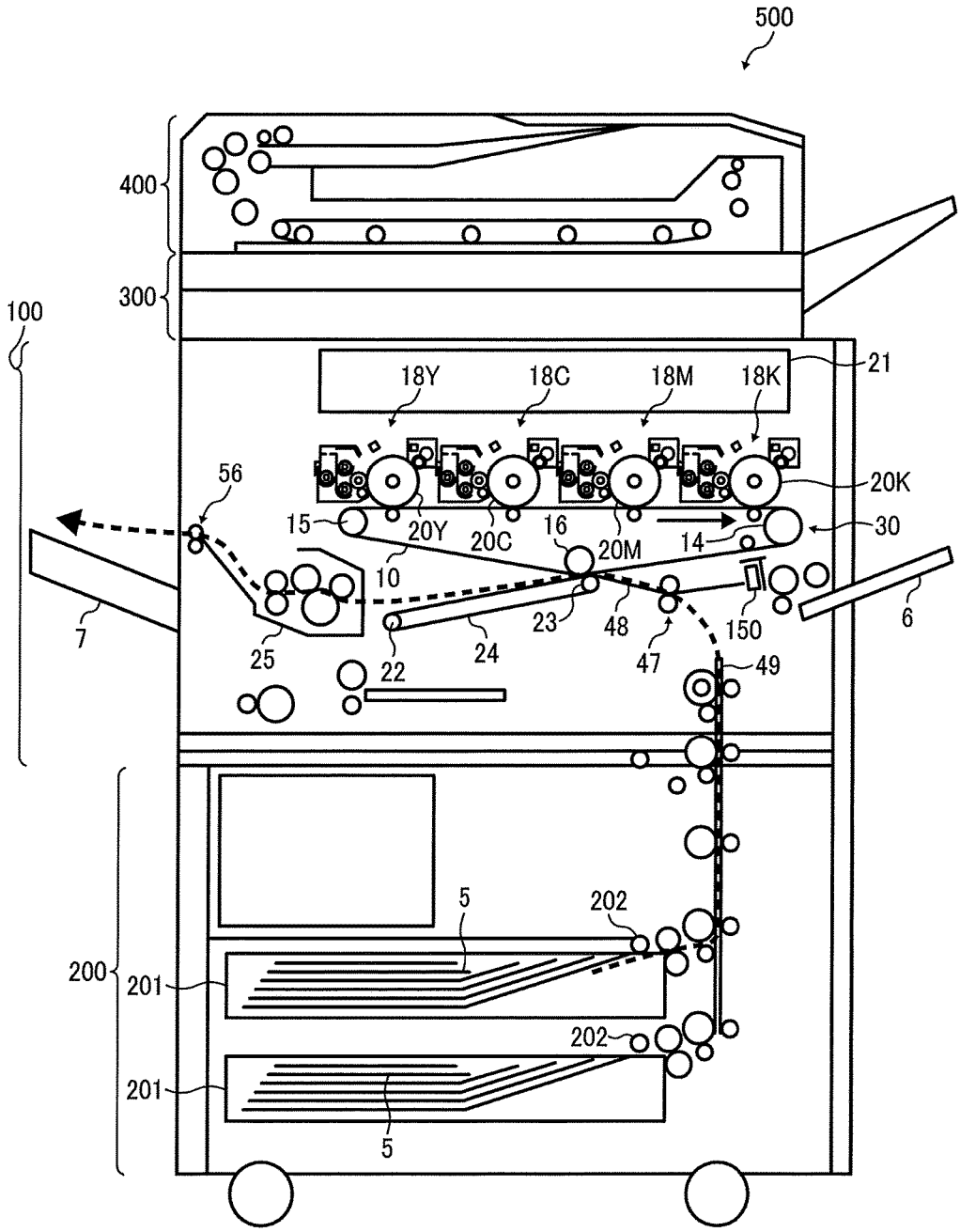
FIG. 1 is a schematic view of an image forming apparatus, such as a copier, according to an embodiment of the present disclosure.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

It is to be noted that the suffixes Y, M, C, and K attached to each reference numeral indicate only that components indicated thereby are used for forming yellow, magenta, cyan, and black images, respectively, and hereinafter may be omitted when color discrimination is not necessary.

Descriptions are given below of a basic structure of an image forming apparatus, such as a full color copier using electrophotography (hereinafter simply "copier"), to which one or more of aspects of the present disclosure are applied, with reference to the drawings, wherein like reference numerals designate identical or corresponding parts throughout the several views thereof, and particularly to FIG. 1, an image forming apparatus employing electrophotography, according to an embodiment of the present disclosure is described.

FIG. 1 is a schematic view of a copier 500 according to the present embodiment. As illustrated in FIG. 1, the copier 500 includes an image forming section 100 to form an image on a recording sheet 5, a sheet feeder 200 to supply the recording sheet 5 to the image forming section 100, and a scanner 300 to read an image on a document. In addition, an automatic document feeder (ADF) 400 is disposed above the scanner 300. The image forming section 100 includes a bypass feeder 6 (i.e., a side tray) to feed a recording sheet different from the recording sheets 5 contained in the sheet feeder 200, and a stack tray 7 to stack the recording sheet 5 after an image has been formed thereon.

Figure 2:
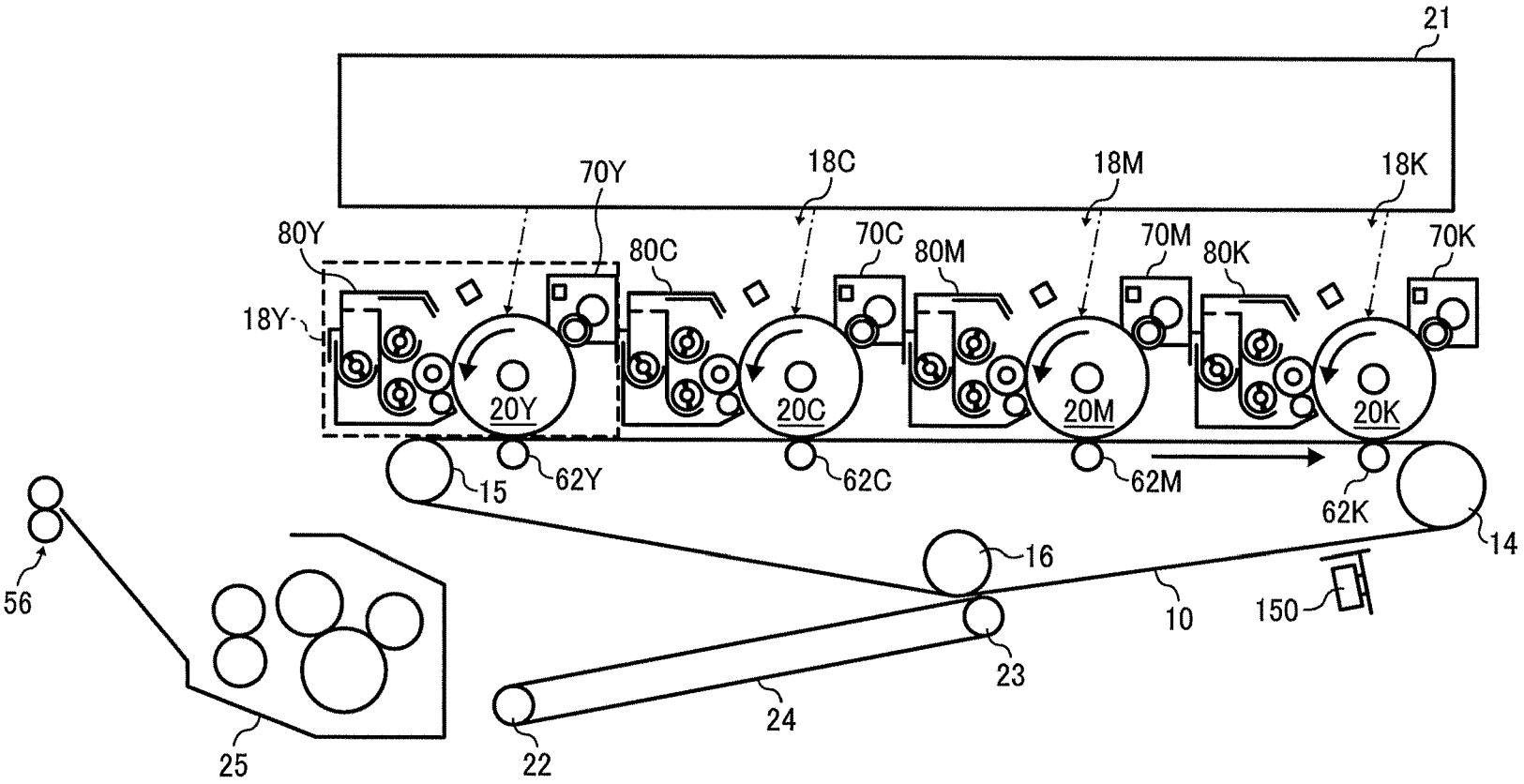
FIG. 2 is an enlarged view illustrating an image forming section of the copier illustrated in FIG. 1.

FIG. 2 is an enlarged view of the image forming section 100. The image forming section 100 includes a transfer unit 30 including an intermediate transfer belt 10 that is an endless belt serving as a transfer member. The intermediate transfer belt 10 of the transfer unit 30 is stretched around three support rollers 14, 15, and 16 and moves endlessly clockwise in FIGS. 1 and 2, as one of the three support rollers rotates. Four image forming units corresponding to yellow (Y), cyan (C), magenta (M), and black (K) are disposed opposite the outer side of a portion of the intermediate transfer belt 10 moving between the support roller 14 and the support roller 15. An optical sensor unit 150 to detect an image density (that is, toner adhesion amount per unit area) of a toner image formed on the intermediate transfer belt 10 is disposed opposite the outer side of the portion of the intermediate transfer belt 10 moving between the support roller 14 and the support roller 16. The optical sensor unit 150 serves as an image density detector.

In FIG. 1, a laser writing device 21 is disposed above image forming units 18Y, 18C, 18M, and 18K serving as image forming devices, respectively. The laser writing device 21 emits writing light based on image data of a document read by the scanner 300 or image data sent from an external device such as a personal computer. Specifically, based on the image data, a laser controller drives a semiconductor laser to emit the writing light. The writing light exposes and scans each of the drum-shaped photoconductors 20Y, 20C, 20M, and 20K, serving as latent image bearers, of the image forming units 18Y, 18C, 18M, and 18K, thereby forming an electrostatic latent image thereon. The light source of the writing light is not limited to a laser diode but can be a light-emitting diode (LED), for example.

Figure 3:
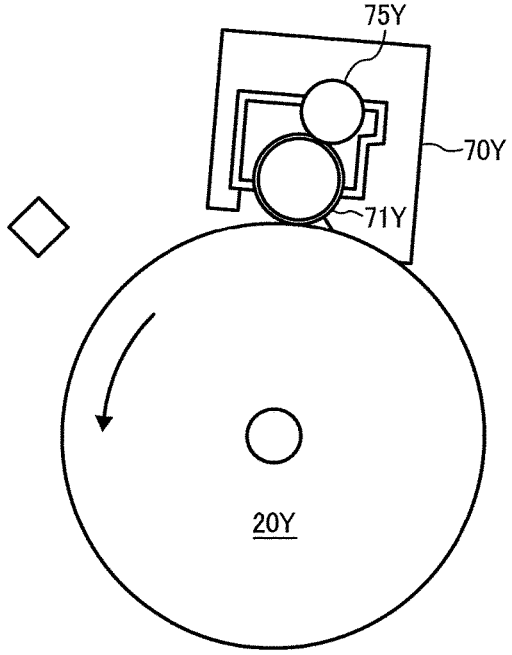
FIG. 3 is an enlarged view illustrating a photoconductor and a charging device for yellow in the image forming section illustrated in FIG. 2.

FIG. 3 is an enlarged view of the photoconductor 20Y and the charging device 70Y for yellow. Components for forming yellow images will be described as representatives. The charging device 70Y includes a charging roller 71Y that contacts the photoconductor 20Y to rotate following a rotation of the photoconductor 20Y, a charging roller cleaner 75Y that contacts the charging roller 71Y to rotate following a rotation of the charging roller 71Y, and a rotary attitude sensor, which is described later.

Figure 4:
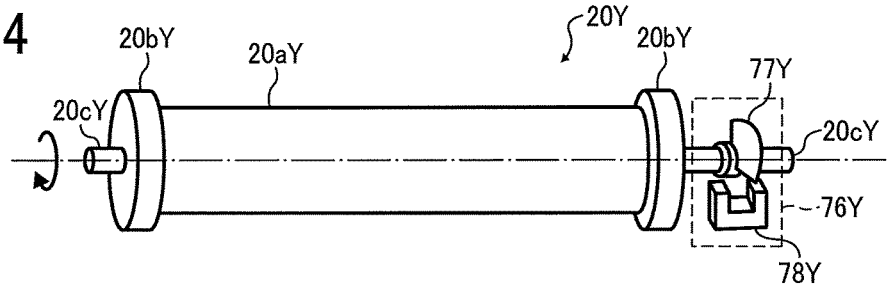
FIG. 4 is an enlarged perspective view illustrating the photoconductor illustrated in FIG. 3.

FIG. 4 is an enlarged perspective view of the photoconductor 20Y for yellow. The photoconductor 20Y includes a columnar body 20*a*Y, large-diameter flanges 20*b*Y disposed at both ends of the columnar body 20*a*Y in the axial direction thereof, and a rotation shaft 20*c*Y rotatably supported by bearings.

One end of the rotation shaft 20*c*Y, which protrudes from the end face of each of the two flanges 20*b*Y, penetrates the photoconductor rotation sensor 76Y, and the portion protruding from the photoconductor rotation sensor 76Y is received by the bearing. The photoconductor rotation sensor 76Y includes a light shield 77Y secured to the rotation shaft 20*c*Y to rotate together with the rotation shaft 20*c*Y, and a transmission photosensor 78Y. The light shield 77Y has a shape protruding from a predetermined position of the rotation shaft 20*c*Y in the direction normal to the rotation shaft 20*c*Y. When the photoconductor 20Y takes a predetermined rotation attitude, the light shield 77Y is interposed between a light-emitting element and a light-receiving element of the transmission photosensor 78Y. With this structure, when the light-receiving element does not receive light, the voltage output from the transmission photosensor 78Y decreases significantly. Specifically, the transmission photosensor 78Y significantly decreases the output voltage detecting the photoconductor 20Y being in a predetermined rotation attitude.

Figure 5:
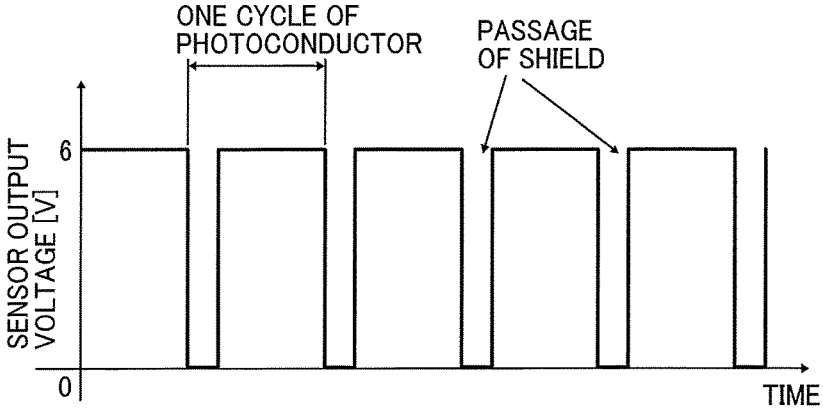
FIG. 5 is a graph illustrating a change with time in output voltage from a photoconductor rotation sensor for yellow in the image forming section illustrated in FIG. 2.

FIG. 5 is a graph illustrating changes with time in the output voltage from the photoconductor rotation sensor 76Y for yellow. More specifically, the output voltage from the photoconductor rotation sensor 76Y is an output voltage from the transmission photosensor 78Y. As illustrated in FIG. 5, the photoconductor rotation sensor 76Y outputs a predetermined voltage (e.g., 6 volts) most of time during which the photoconductor 20Y rotates. However, each time the photoconductor 20Y makes a complete turn, the output voltage from the photoconductor rotation sensor 76Y instantaneously falls to nearly 0 volt. Because, each time the photoconductor 20Y makes a complete turn, the light shield 77Y is interposed between the light-emitting element and the light-receiving element of the transmission photosensor 78Y, thus blocking the light to be received by the light-receiving element. The output voltage greatly decreases when the photoconductor 20Y is in a predetermined rotation attitude. Hereinafter, this timing is called "reference attitude timing."

Referring back to FIG. 3, the charging roller cleaner 75Y of the charging device 70Y includes a conductive cored bar and an elastic layer covering the core bar. The elastic layer, which is a sponge body produced by foaming or expanding melamine resin to have micro pores, rotates while contacting the charging roller 71Y. While rotating, the charging roller cleaner 75 removes dust, residual toner, and the like from the charging roller 71Y to suppress creation of substandard images.

Referring back to FIG. 2, the four image forming units 18Y, 18C, 18M, and 18K are similar in structure, except the color of toner used therein. For example, the image forming unit 18Y to form yellow toner images includes the photoconductor 20Y, the charging device 70Y, and a developing device 80Y.

The charging device 70Y charges the surface of the photoconductor 20Y uniformly to a negative polarity. Of the uniformly charged surface of the photoconductor 20Y, the portion irradiated with the laser light from the laser writing device 21 has an attenuated potential and becomes an electrostatic latent image.

Figure 6:
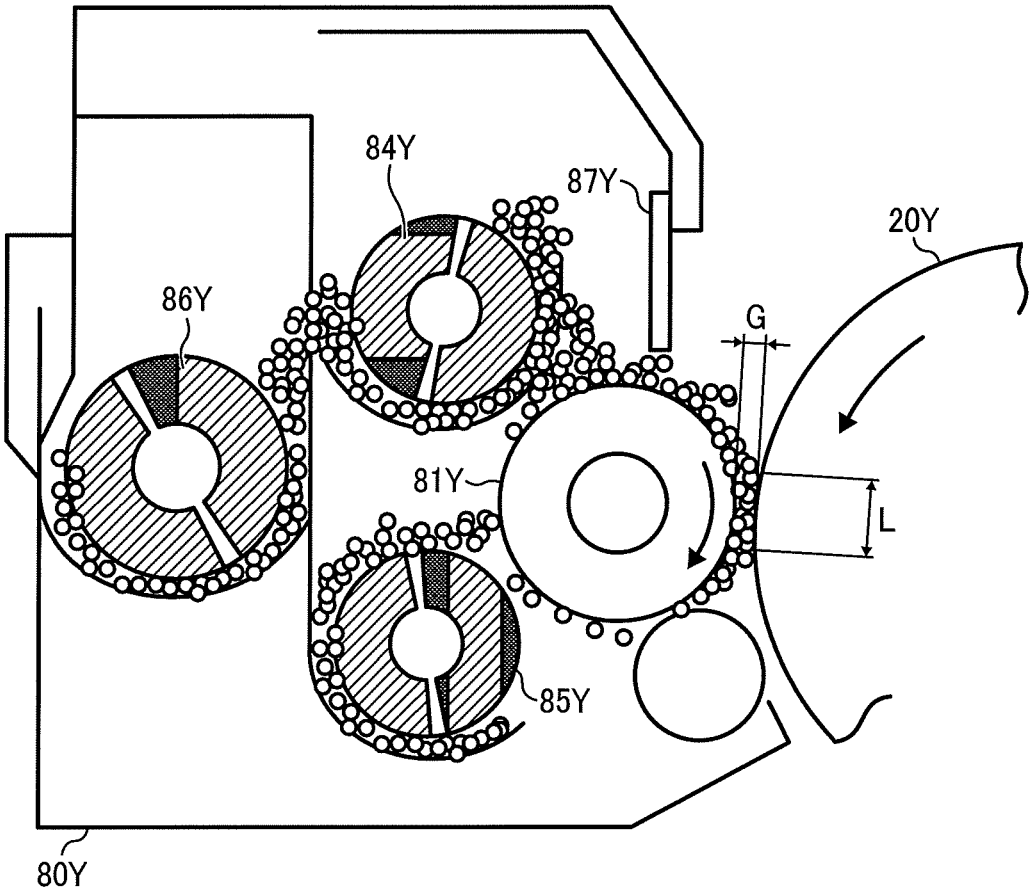
FIG. 6 is a schematic cross-sectional view of a developing device and the photoconductor in the image forming section.

FIG. 6 schematically illustrates the developing device 80Y for yellow and a portion of the photoconductor 20Y for yellow. The developing device 80Y employs two component development in which two component developer including magnetic carriers and nonmagnetic toner is used for image developing. Alternatively, one-component development using one-component developer that does not include magnetic carriers may be employed. The developing device 80Y includes a stirring section and a developing section within a development case. In the stirring section, the two-component developer (hereinafter, simply "developer") is stirred by three screws (a supply screw 84Y, a collecting screw 85Y, and a stirring screw 86Y) and is conveyed to the developing section.

The developing section includes a rotary developing sleeve 81Y disposed opposite the photoconductor 20Y via an opening of the development case, across a predetermined development gap G. The developing sleeve 81Y serving as a developer bearer includes a magnet roller, which does not rotate together with the developing sleeve 81Y.

The supply screw 84Y and the collecting screw 85Y in the stirring section and the developing sleeve 81Y in the developing section extend in a horizontal direction and are parallel to each other. By contrast, the stirring screw 86Y in the stirring section is inclined to rise from the front side to the backside of the paper on which FIG. 6 is drawn.

While rotating, the supply screw 84Y of the stirring section conveys the developer from the backside to the front side of the paper on which FIG. 6 is drawn to supply the developer to the developing sleeve 81Y of the developing section. The developer that is not supplied to the developing sleeve 81Y but is conveyed to the front end of the development case in the above-mentioned direction falls to the collecting screw 85Y disposed immediately below the supply screw 84Y.

The developer supplied to the developing sleeve 81Y by the supply screw 84Y of the stirring section is scooped up onto the developing sleeve 81Y due to the magnetic force exerted by the magnet roller inside the developing sleeve 81Y. The magnetic force of the magnet roller causes the scooped developer to stand on end on the surface of the developing sleeve 81Y, forming a magnetic brush. As the developing sleeve 81Y rotates, the developer passes through a regulation gap between a leading end of a regulation blade 87Y and the developing sleeve 81Y, where the thickness of a layer of developer on the developing sleeve 81Y is regulated. Then, the developer is conveyed to a developing range opposite the photoconductor 20Y.

In the developing range, the developing bias applied to the developing sleeve 81Y causes a developing potential. The developing potential gives an electrostatic force trending to the electrostatic latent image to the toner of developer located facing the electrostatic latent image on the photoconductor 20Y. In addition, background potential acts on the toner located facing a background portion on the photoconductor 20Y, of the toner in developer. The background potential gives an electrostatic force trending to the surface of the developing sleeve 81Y. As a result, the toner moves to the electrostatic latent image on the photoconductor 20Y, developing the electrostatic latent image. Thus, a yellow toner image is formed on the photoconductor 20Y. The yellow toner image enters a primary transfer nip for yellow as the photoconductor 20Y rotates.

As the developing sleeve 81Y rotates, the developer that has passed through the developing range reaches an area where the magnetic force of the magnet roller is weaker. Then, the developer leaves the developing sleeve 81Y and returns to the collecting screw 85Y of the stirring section. While rotating, the collecting screw 85Y conveys the developer collected from the developing sleeve 81Y from the backside to the front side of the paper on which FIG. 6 is drawn. At the front end of the developing device 80Y in the above-mentioned direction, the developer is received to the stirring screw 86Y.

While rotating, the stirring screw 86Y conveys the developer received from the collecting screw 85Y to the backside from the front side in the above-mentioned direction. During this process, a toner concentration sensor 82Y, which is a magnetic permeability sensor as an example, (described later referring to FIGS. 7A and 7B), detects the concentration of toner. Based on the detection result, toner is supplied as required. Specifically, to supply toner, a controller 110 (illustrated in FIGS. 7A and 7B) drives a toner supply device according to the readings of the toner concentration sensor. The developer to which the toner is thus supplied is conveyed to the back end of the development case in the above-mentioned direction and is received by the supply screw 84Y.

The description above concerns formation of yellow images in the image forming unit 18Y for yellow. In the image forming units 18C, 18M, and 18K, cyan, magenta, and black toner images are formed on the photoconductors 20C, 20M, and 20K, respectively, through similar processes.

In FIG. 2, primary transfer rollers 62Y, 62C, 62M, and 62K are disposed inside the loop of the intermediate transfer belt 10 and nip the intermediate transfer belt 10 together with the photoconductors 20Y, 20C, 20M, and 20K. Accordingly, the outer face (front side) of the intermediate transfer belt 10 contacts the photoconductors 20Y, 20M, 20C, and 20K, and the contact portions therebetween serve as primary transfer nips for yellow, magenta, cyan, and black, respectively. Primary electrical fields are respectively generated between the primary transfer rollers 62Y, 62C, 62M, and 62K and the photoconductors 20Y, 20C, 20M, and 20K, to each of which the primary transfer bias is applied.

The outer face of the intermediate transfer belt 10 sequentially passes the primary transfer nips for yellow, cyan, magenta, and black as the intermediate transfer belt 10 rotates. During such a process, yellow, magenta, cyan, and black toner images are sequentially transferred from the photoconductors 20Y, 20C, 20M, and 20K and superimposed on the outer face of the intermediate transfer belt 10 (i.e., primary transfer process). Thus, a four-color superimposed toner image is formed on the outer face of the intermediate transfer belt 10.

Below the intermediate transfer belt 10, an endless conveyor belt 24 is stretched around a first tension roller 22 and a second tension roller 23. The conveyor belt 24 rotates counterclockwise in the drawing as one of the tension rollers 22 and 23 rotates. The outer face of the conveyor belt 24 contacts a portion of the intermediate transfer belt 10 winding around the support roller 16, and the contact portion therebetween is called "secondary transfer nip." Around the secondary transfer nip, a secondary transfer electrical field is generated between the second tension roller 23, which is grounded, and the support roller 16, to which a secondary transfer bias is applied.

Referring back to FIG. 1, the image forming section 100 includes a conveyance path 48, through which the recording sheet 5 fed from the sheet feeder 200 or the bypass feeder 6 is sequentially transported to the secondary transfer nip, a fixing device 25 described later, and an ejection roller pair 56. The image forming section 100 includes another conveyance path 49 to convey the recording sheet 5 fed to the image forming section 100 from the sheet feeder 200 to an entrance of the conveyance path 48. A registration roller pair 47 is disposed at the entrance of the conveyance path 48.

When a print job is started, the recording sheet 5, fed from the sheet feeder 200 or the bypass feeder 6, is conveyed to the conveyance path 48. The recording sheet 5 then abuts against the registration roller pair 47. The registration roller pair 47 starts rotation at a proper timing, thereby sending the recording sheet 5 toward the secondary transfer nip. In the secondary transfer nip, the four-color superimposed toner image on the intermediate transfer belt 10 tightly contacts the recording sheet 5. The four-color superimposed toner image is secondarily transferred en bloc onto the surface of the recording sheet 5 due to effects of the secondary transfer electrical field and nip pressure. Thus, a full-color toner image is formed on the recording sheet 5.

The conveyor belt 24 conveys the recording sheet 5 that has passed through the secondary transfer nip to the fixing device 25. The recording sheet 5 is pressed and heated inside the fixing device 25, thereby the full-color toner image is fixed on the surface of the recording sheet 5. After discharged from the fixing device 25, the recording sheet 5 is conveyed to the ejection roller pair 56 and ejected onto the stack tray 7.

Figures 7, 7A:
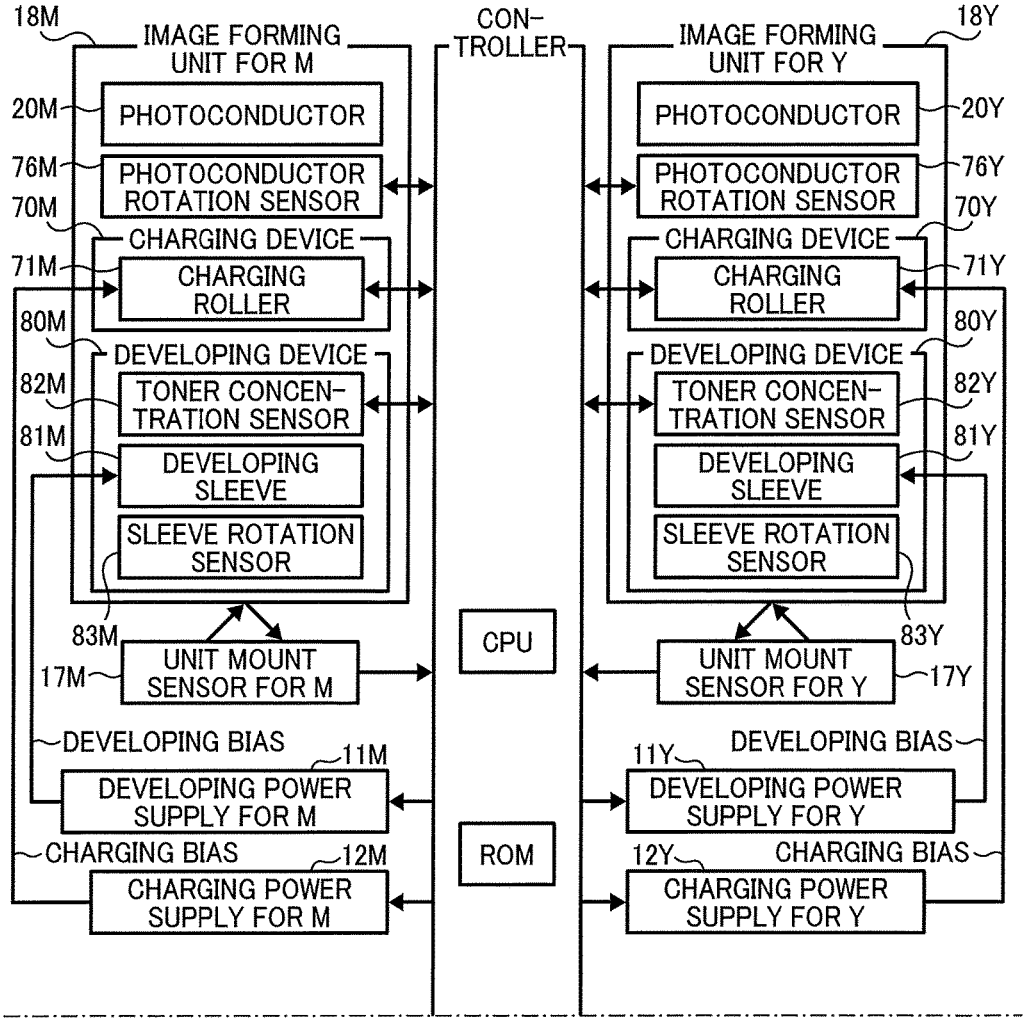
FIGS. 7A and 7B (collectively referred to as FIG. 7) are block diagrams illustrating a main part of circuitry of the copier illustrated in FIG. 1.
Figure 7B:
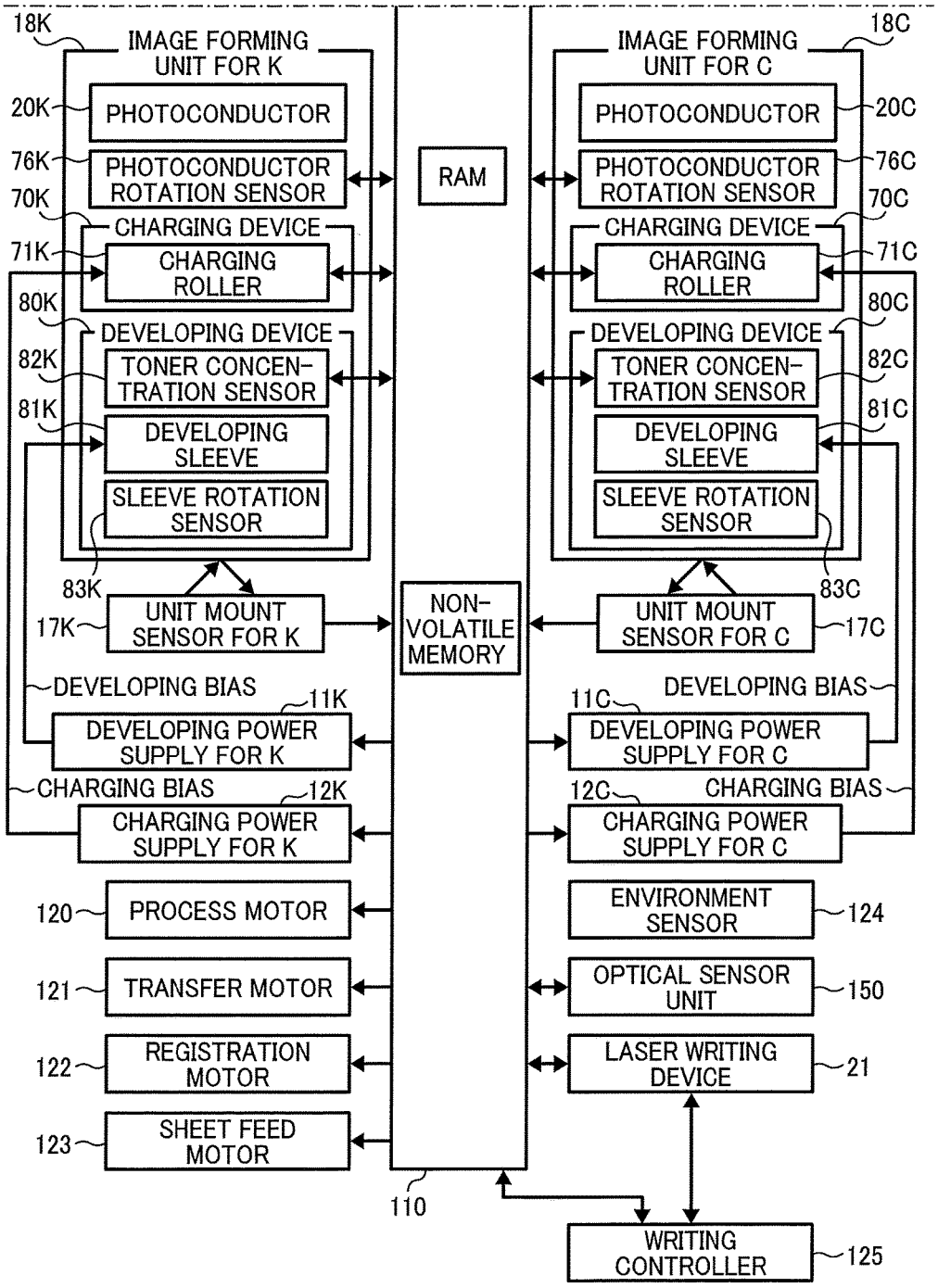

FIGS. 7A and 7B are block diagrams illustrating a main part of circuitry of the copier 500 according to the present embodiment. In the configuration illustrated in FIGS. 7A and 7B, the controller 110 includes a central processing unit (CPU), a random access memory (RAM), a read only memory (ROM), a nonvolatile memory, and the like. The controller 110 is electrically connected to the toner concentration sensors 82Y, 82C, 82M, and 82K of the yellow, cyan, magenta, and black developing devices 80Y, 80C, 80M, and 80K, respectively. With this structure, the controller 110 obtains the toner concentration of yellow developer, cyan developer, magenta developer, and black developer contained in the developing devices 80Y, 80C, 80M, and 80K, respectively.

Unit mount sensors 17Y, 17C, 17M, and 17K for yellow, cyan, magenta, and black, serving as replacement detectors, are also electrically connected to the controller 110. The unit mount sensors 17Y, 17C, 17M, and 17K respectively detect removal of the image forming units 18Y, 18C, 18M, and 18K from the image forming section 100 and mounting thereof in the image forming section 100. With this structure, the controller 110 recognizes that the image forming units 18Y, 18C, 18M, and 18K have been mounted in or removed from the image forming section 100.

In addition, developing power supplies 11Y, 11C, 11M, and 11K for yellow, cyan, magenta, and black are electrically connected to the controller 110. The controller 110 outputs control signals to the developing power supplies 11Y, 11C, 11M, and 11K respectively, to adjust the value of developing bias output from each of the developing power supplies 11Y, 11C, 11M, and 11K. That is, the values of developing biases applied to the developing sleeves 81Y, 81C, 81M, and 81K for yellow, cyan, magenta, and black can be individually adjusted.

In addition, charging power supplies 12Y, 12C, 12M, and 12K for yellow, cyan, magenta, and black are electrically connected to the controller 110. The controller 110 outputs control signals to the charging power supplies 12Y, 12C, 12M, and 12K, respectively, to adjust the value of direct current (DC) voltage in the charging bias output from each of the charging power supplies 12Y, 12C, 12M, and 12K, individually. That is, the values of direct current voltage in the charging biases applied to the charging rollers 71Y, 71C, 71M, and 71K for yellow, cyan, magenta, and black can be individually adjusted.

In addition, the photoconductor rotation sensors 76Y, 76C, 76M, and 76K to individually detect the photoconductors 20Y, 20C, 20M, and 20K for yellow, cyan, magenta, and black being in the predetermined rotation attitude are electrically connected to the controller 110. Accordingly, based on the detection output from the photoconductor rotation sensors 76Y, 76C, 76M, and 76K, the controller 110 individually recognizes whether or not each of the photoconductors 20Y, 20C, 20M, and 20K for yellow, cyan, magenta, and black is in the predetermined rotation attitude.

Sleeve rotation sensors 83Y, 83C, 83M, and 83K of the developing devices 80Y, 80C, 80M, and 80K, respectively, are also electrically connected to the controller 110. The sleeve rotation sensors 83Y, 83C, 83M, and 83K, each serving as a rotation attitude sensor, are similar in structure to the photoconductor rotation sensors 76Y, 76C, 76M, and 76K and configured to detect the developing sleeves 81Y, 81C, 81M, and 81K being in predetermined rotation attitudes, respectively. In other words, based on the detection output from the sleeve rotation sensors 83Y, 83C, 83M, and 83K, the controller 110 individually recognizes the timing at which each of the developing sleeves 81Y, 81C, 81M, and 81K takes the predetermined rotation attitude.

In addition, a writing controller 125, an environment sensor 124, the optical sensor unit 150, a process motor 120, a transfer motor 121, a registration motor 122, a sheet feeding motor 123, and the like are electrically connected to the controller 110. The environment sensor 124 detects the temperature and the humidity inside the apparatus. The process motor 120 is a driving source for the image forming units 18Y, 18C, 18M, and 18K. The transfer motor 121 is a driving source for the intermediate transfer belt 10. The registration motor 122 is a driving source for the registration roller pair 47. The sheet feeding motor 123 is a driving source to drive pickup rollers 202 to send out the recording sheet 5 from sheet trays 201 of the sheet feeder 200. The writing controller 125 controls driving of the laser writing device 21 based on the image data. The function of the optical sensor unit 150 is described later.

The copier 500 according to the present embodiment performs a control operation called "process control" regularly at predetermined timings to stabilize the image density over a long time regardless of environmental changes or the like. In the process control, a yellow patch pattern image (a toner image) including multiple patch-shaped yellow toner images (i.e., toner patches) is formed on the photoconductor 20Y and transferred onto the intermediate transfer belt 10. Each of the patch-shaped yellow toner images is used for detecting the amount of yellow toner adhering. The controller 110 similarly forms cyan, magenta, and black patch pattern images on the photoconductors 20C, 20M, and 20K, respectively, and transfers the patch pattern images onto the intermediate transfer belt 10 so as not to overlap. Then, the optical sensor unit 150 detects a toner adhesion amount of each toner patch in the patch pattern image of each color. Subsequently, based on the readings obtained, image forming conditions, such as a developing bias reference value being a reference value of the developing bias Vb, are adjusted individually for each of the image forming units 18Y, 18C, 18M, and 18K.

The optical sensor unit 150 includes four reflective photosensors aligned in the width direction of the intermediate transfer belt 10, which is hereinafter referred to as "belt width direction," at predetermined intervals. Each reflective photosensor outputs a signal corresponding to the reflectance light on the intermediate transfer belt 10 or the patch-shaped toner image on the intermediate transfer belt 10. Three of the four reflective photosensors capture both of specular reflection light and diffuse reflection light on the belt surface and output signals according to the amount of respective light amounts so that the output signal corresponds to the adhesion amount of the corresponding one of yellow, magenta, and cyan toners.

Figure 8:
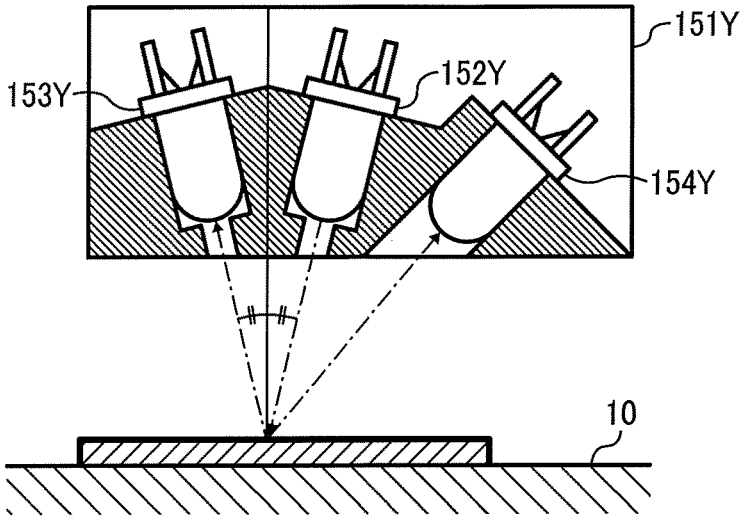
FIG. 8 is an enlarged view of a reflective photosensor for yellow mounted on an optical sensor unit of the copier illustrated in FIG. 1.

FIG. 8 is an enlarged view of a reflective photosensor 151Y for yellow mounted in the optical sensor unit 150. The reflective photosensor 151Y includes a light-emitting diode (LED) 152Y as a light source, a light-receiving element 153Y that receives the specular reflection light, and a light-receiving element 154Y that receives the diffused reflection light. The light-receiving element 153Y outputs a voltage corresponding to the amount of specular reflection light on the surface of the yellow toner patch (patch-shaped toner image). The light-receiving element 154Y outputs a voltage corresponding to the amount of diffuse reflection light on the surface of the yellow toner patch (patch-shaped toner image). The controller 110 calculates the adhesion amount of yellow toner of the yellow toner patch based on the output voltage. The reflective photosensors 151C and 151M for cyan and magenta are similar in structure to the reflective photosensor 151Y for yellow described above.

Figure 9:
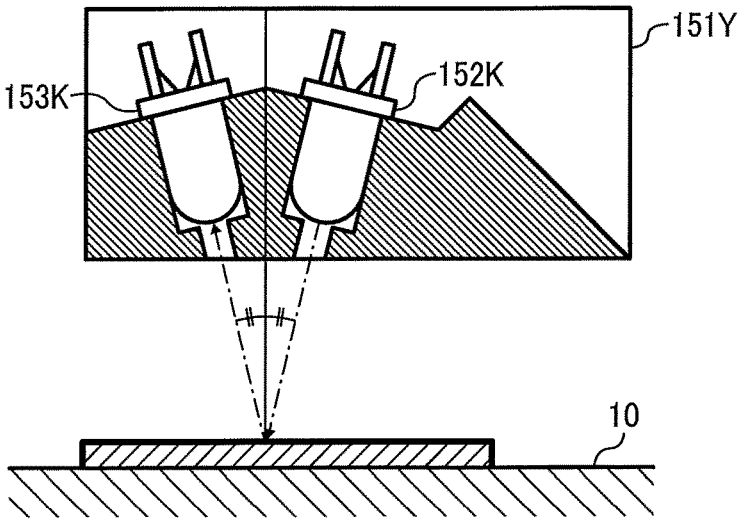
FIG. 9 is an enlarged view of a reflective photosensor for black mounted on the optical sensor unit illustrated in FIG. 8.

FIG. 9 is an enlarged view of a reflective photosensor 151K for black, mounted in the optical sensor unit 150. The reflective photosensor 151K includes an LED 152K, serving as a light source, and a light-receiving element 153K that receives specular reflection light. The light-receiving element 153K outputs a voltage corresponding to the amount of specular reflection light on the surface of the black toner patch. The controller 110 calculates the toner adhesion amount of the black toner patch based on the output voltage.

In the present embodiment, the LED 152 for each color employs a gallium arsenide (GaAs) infrared light-emitting diode to emit light having a peak wavelength of 950 nm. For the light-receiving elements 153 to receive specular reflection and the light-receiving elements 154 to receive diffuse reflection, silicon (Si) phototransistors having a peak light receiving sensitivity of 800 nm are used. However, the peak wavelength and the peak light receiving sensitivity are not limited to the values mentioned above.

The four reflective photosensors are disposed approximately 5 millimeters from the outer face of the intermediate transfer belt 10.

The controller 110 performs the process control at a predetermined timing, such as, turning on of a main power, standby time after elapse of a predetermined period, and standby time after printing on a predetermined number of sheets or greater. When the process control is started, initially, the controller 110 obtains information such as the number of sheets fed, coverage rate, and environmental information such as temperature and humidity and the controller 110 ascertains individual development properties in the image forming units 18Y, 18C, 18M, and 18K. Specifically, the controller 110 calculates development y and development threshold voltage for each color. More specifically, the controller 110 causes the charging devices 70Y, 70C, 70M, and 70K to uniformly charge the photoconductors 20Y, 20C, 20M, and 20K while rotating the photoconductors 20. In the charging, the charging power supplies 12Y, 12C, 12M, and 12K output charging biases different from those for normal printing. More specifically, of the charging bias, which is a superimposed bias including the direct current voltage and the alternating current voltage, the direct current voltage is not set constant but is gradually increased in absolute value. The laser writing device 21 scans, with the laser light, the photoconductors 20Y, 20C, 20M, and 20K charged under such conditions, to form a plurality of electrostatic latent images for the patch-shaped toner image of yellow, cyan, magenta, and black. The developing devices 80Y, 80C, 80M, and 80K develop the latent images thus formed, respectively, to form the patch pattern images of yellow, cyan, magenta, and black on the photoconductors 20Y, 20C, 20M, and 20K. In the developing, the controller 110 gradually increases the absolute value of each of developing biases applied to the developing sleeves 81Y, 81C, 81M, and 81K. At that time, the developing potential for each patch-shaped toner image, which is the difference between the developing bias and the electrostatic latent image potential of each patch-shaped toner image, is stored in the RAM.

Figure 10:
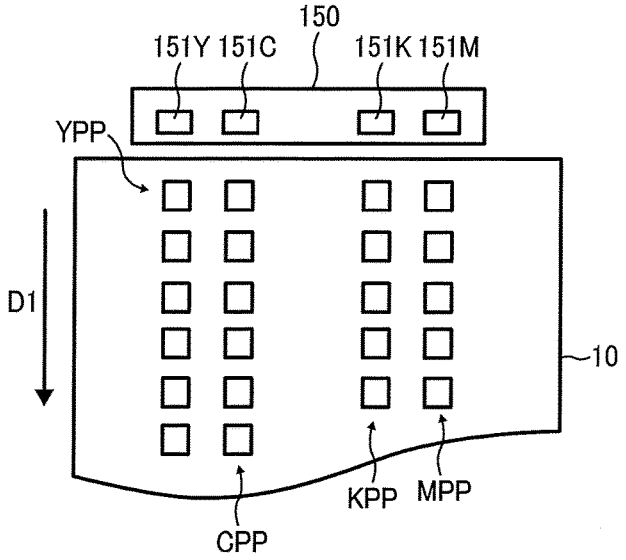
FIG. 10 illustrates a patch pattern image for each color transferred onto an intermediate transfer belt, according to an embodiment.

As illustrated in FIG. 10, patch pattern images YPP, CPP, MPP, and KPP of yellow, cyan, magenta, and black (collectively "patch pattern images PP") are arranged in the belt width direction so as not to overlap on the intermediate transfer belt 10. Specifically, the patch pattern image YPP is disposed on a first end side (on the left in FIG. 10) of the intermediate transfer belt 10 in the belt width direction. The patch pattern image CPP is disposed at a position shifted to a center from the patch pattern image YPP in the belt width direction. The patch pattern image MPP is disposed on a second end side (on the right in FIG. 10) of the intermediate transfer belt 10 in the belt width direction. The patch pattern image KPP is disposed at a position shifted to the center from the patch pattern image MPP in the belt width direction.

The optical sensor unit 150 includes the reflective photosensor 151Y for yellow, the reflective photosensor 151C for cyan, the reflective photosensor 151K for black, and the reflective photosensor 151M for magenta to detect the light reflection characteristics of the intermediate transfer belt 10 at different positions in the belt width direction.

The reflective photosensor 151Y is disposed to detect the amount of toner adhering to the yellow toner patches in the patch pattern image YPP on the first end side of the intermediate transfer belt 10 in the belt width direction. The reflective photosensor 151C is disposed to detect the amount of toner adhering to the cyan toner patches in the patch pattern image CPP close to the toner patch pattern YPP in the belt width direction. The reflective photosensor 151M is disposed to detect the amount of toner adhering to the magenta toner patches in the patch pattern image MPP on the second end side of the intermediate transfer belt 10 in the belt width direction. The reflective photosensor 151K is disposed to detect the amount of toner adhering to the black toner patches of the patch pattern image KPP close to the patch pattern image MPP in the belt width direction.

Based on the signals sequentially output from the four photosensors (151Y, 151C, 151M, and 151K) of the optical sensor unit 150, the controller 110 calculates the reflectance of light of the toner patches of four colors, obtains the amount of toner adhering (i.e., toner adhesion amount) to each toner patch based on the computation result, and stores the calculated toner adhesion amounts in the RAM. After passing by the position facing the optical sensor unit 150 as the intermediate transfer belt 10 rotates, the toner patch patterns PP are removed from the intermediate transfer belt 10 by a cleaning device.

Figure 11:
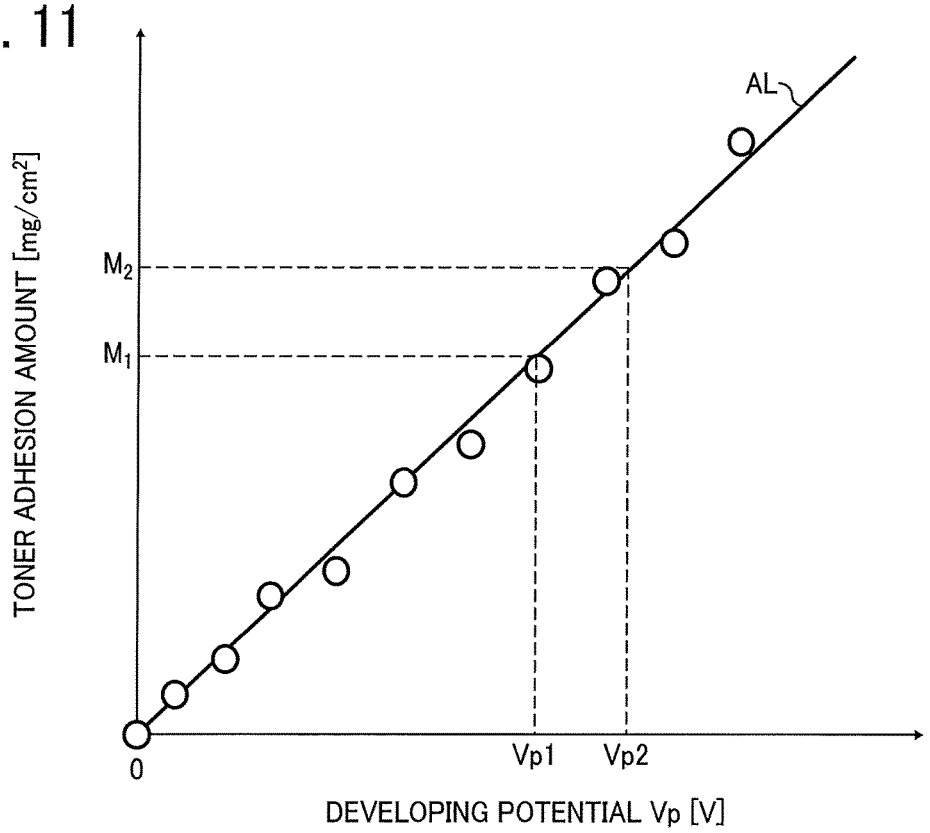
FIG. 11 is a graph of an approximation line representing a relation between toner adhesion amount and developing bias, constructed in process control processing.

The controller 110 calculates a linear approximation formula Y=a×Vp+b, based on the toner adhesion amount stored in the RAM and data on the latent image potential and developing bias Vb regarding each toner patch stored in the RAM separately from the toner adhesion amount. Specifically, controller 110 calculates a formula of approximate straight line (AL in FIG. 11) representing the relation between the toner adhesion amount (Y-axis) and the developing potential (X-axis) in X-Y coordinate, as illustrated in FIG. 11. Based on the formula for an approximate straight line, the controller 110 obtains a developing potential Vp (e.g., Vp1 or Vp2 in FIG. 11) to achieve a target toner adhesion amount (e.g., M1 or M2 in FIG. 11) and further obtains the developing bias reference value and the charging bias reference value (and laser diode power or LD power) to achieve the developing potential Vp. The obtained results are stored in the nonvolatile memory. The controller 110 performs calculation and recording of the developing bias reference value and the charging bias reference value (and LD power) for each of yellow, cyan, magenta, and black and terminates the process control. Thereafter, when the controller 110 runs a print job, the controller 110 causes the developing power supplies 11Y, 11C, 11M, and 11K to output the developing biases Vb based on the developing bias reference value stored, for each of yellow, cyan, magenta, and black, in the nonvolatile memory. In addition, the controller 110 causes the charging power supplies 12Y, 12C, 12M, and 12K to output the charging bias Vd based on the charging bias reference value stored in the nonvolatile memory and causes the laser writing device 21 to output the LD power.

The controller 110 performs the above-described process control to determine the developing bias reference value, the charging bias reference value, and the optical writing intensity (or LD power to be described later) to attain the target toner adhesion amount, thereby stabilizing the image density of the whole image regarding each of yellow, cyan, magenta, and black for a long period. However, it is possible that, as the development gap between the photoconductor 20 (20Y, 20C, 20M, and 20K) and the developing sleeve 81 (81Y, 81C, 81M, and 81K) fluctuates (hereinafter "gap fluctuation"), image density fluctuates cyclically even within a single page.

In the image density fluctuation, image density fluctuation occurring with the rotation cycle of the photoconductors 20Y, 20C, 20M, and 20K and image density fluctuation occurring with the rotation cycle of the developing sleeves 81Y, 81C, 81M, and 81K are superimposed. Specifically, if the rotation axis of the photoconductor 20 (20Y, 20C, 20M, or 20K) is eccentric, the eccentricity causes gap fluctuations that vary like a sine curve with each photoconductor rotation. As a result, in the developing electrical field generated between the photoconductor 20 (20Y, 20C, 20M, or 20K) and the developing sleeve 81 (81Y, 81C, 81M, or 81K), the strength of the field fluctuates, drawing a variation curve shaped like a sine curve for each round of the photoconductor 20. Fluctuations in electrical field strength cause the image density fluctuation that draws a sine curve per photoconductor rotation cycle. Further, the external shape of the photoconductor tends to have distortion. The distortion results in cyclic gap fluctuation drawing same patterns per photoconductor rotation, which cause image density fluctuation. Further, eccentricity or distortion of the external shape of the developing sleeve 81 (81Y, 81C, 81M, or 81K) causes gap fluctuation in the cycle of rotation of the developing sleeve 81 (hereinafter "sleeve rotation cycle") and results in cyclic image density fluctuation. In particular, since the image density fluctuation due to the eccentricity or distortion in the shape of the developing sleeve 81, which is smaller in diameter than the photoconductors 20, occurs in relatively short cycle, such image density fluctuation is more noticeable.

In view of the foregoing, in performing print jobs, the controller 110 performs the first fluctuation control for each of yellow, cyan, magenta, and black as follows. Specifically, for each of yellow, cyan, magenta, and black, the controller 110 stores, in the nonvolatile memory, a first pattern data of the developing bias to cause changes in the developing electrical field strength capable of offsetting the image density fluctuation occurring in the cycle of photoconductor rotation. The controller 110 further stores, in the nonvolatile memory, a first pattern data of the developing bias to cause changes in the developing electrical field strength capable of offsetting the image density fluctuation occurring in sleeve rotation cycle. Hereinafter, the former first pattern data is referred to as "a first pattern data for photoconductor cycle." The latter first pattern data is also referred to as "a first pattern data for sleeve cycle."

The first pattern data for photoconductor cycle, which is generated individually for yellow, magenta, cyan, and black, is a pattern for one rotation cycle of the photoconductor, and the pattern is made with reference to the reference attitude timing of the photoconductor 20. The first pattern data is used to change the output of the developing bias from the developing power supplies (11Y, 11C, 11M, and 11K) based on the developing bias reference values for yellow, cyan, magenta, and black determined in the process control. For example, in the case of data table format, the first pattern includes a group of data on differences in the output developing bias at predetermined intervals in a period equivalent to one rotation cycle starting from the reference attitude timing. Leading data in the data group represents the developing bias output difference at the reference attitude timing, and second data, third data, and fourth data to later data represent the developing bias output differences at the predetermined intervals subsequent to the reference attitude timing. For example, an output pattern formed of a group of data 0, −5, −7, −9, . . . represents that the developing bias output differences are 0 V, −5 V, −7 V, −9 V . . . at predetermined intervals, respectively.

To simply suppress the image density fluctuation occurring in photoconductor rotation cycle, the developing bias output from the developing power supply 11 can be a value in which the developing bias reference value is superimposed with the developing bias output difference. In the copier 500 according to the present embodiment, however, to suppress the image density fluctuation in sleeve rotation cycle as well, the developing bias output difference to suppress the image density fluctuation in photoconductor rotation cycle and the developing bias output difference to suppress the image density fluctuation in sleeve rotation cycle are superimposed on the developing bias reference value.

The first pattern data for sleeve cycle, which is generated individually for yellow, magenta, cyan, and black, is a pattern for one rotation cycle of the developing sleeve 81, and the pattern is made with reference to the reference attitude timing of the developing sleeve 81. The first pattern data is used to change the output of the developing bias from the developing power supplies (11Y, 11C, 11M, and 11K) based on the developing bias reference values for yellow, cyan, magenta, and black determined in the process control (i.e., reference value determination process). In the case of data table format, leading data in the data group represents the developing bias output difference at the reference attitude timing, and second data, third data, and fourth data to later data represent the developing bias output differences at the predetermined intervals subsequent to the reference attitude timing. The predetermined intervals are identical to the intervals reflected in the data group in the developing-bias change pattern for photoconductor cycle.

In an image forming process, the controller 110 reads the data from the first pattern data for photoconductor cycle, which individually corresponds to yellow, cyan, magenta, and black, at the predetermined intervals. Simultaneously, the controller 110 also reads the data of the first pattern data for sleeve cycle, which individually correspond to yellow, cyan, magenta, and black, at the identical predetermined intervals. In reading the data, in the case where the reference attitude timing does not arrive even after the last data of the data group is read, the controller 110 sets the read value identical to the last data until the reference attitude timing arrives. In the case where the reference attitude timing arrives before the last data of the data group is read, the data read position is returned to the initial data. Regarding the reading of data from the first pattern data for photoconductor cycle, a timing at which the photoconductor rotation sensor 76 transmits the reference attitude timing signal is used as the reference attitude timing. Regarding the reading of data from the first pattern data for sleeve cycle, a timing at which the sleeve rotation sensor 83 transmits the reference attitude timing signal is used as the reference attitude timing.

For each of yellow, cyan, magenta, and black, in such a data reading process, the data read from the first pattern data for photoconductor cycle and that from the first pattern data for sleeve cycle are added together to calculate the superimposed value. For example, when the data read from the first pattern data for photoconductor cycle indicates −5 V and the data read from the first pattern data for sleeve cycle indicates 2 V, −5 V and 2 V are added together. Then, the superimposed value is −3 V. When the developing bias reference value is −550 V, the result of addition of the superimposed value is −553 V, which is output from the developing power supply 11. Such process is performed for each of yellow, cyan, magenta, and black at the predetermined intervals.

With this process, the developing electrical field between the photoconductor 20 and the developing sleeve 81 is varied in strength to offset an electrical field strength variation that is a superimposition of two types of variations in the electrical field strength, namely, (1) electrical field strength variation caused by the gap fluctuation in photoconductor rotation cycle, due to eccentricity or distortion in the external shape of the photoconductor 20, and (2) electrical field strength variation in sleeve rotation cycle due to eccentricity or distortion in the external shape of the developing sleeve 81. With such process, regardless of the rotation attitude of the photoconductor 20 and that of the developing sleeve 81, the developing electrical field between the photoconductor 20 and the developing sleeve 81 can be kept substantially constant. This process can suppress the image density fluctuation occurring in both of the photoconductor rotation cycle and the sleeve rotation cycle.

The first pattern data for photoconductor cycle and the one for sleeve cycle, which individually corresponds to each of yellow, cyan, magenta, and black, are generated by executing a first detection process and a first pattern data process at predetermined timings. Examples of the predetermined timing of the first detection process are as follows. That is, the predetermined timing includes a timing before a first print job and after shipping from factory (hereinafter called an initial startup timing), a replacement detection timing when a replacement of the image forming unit 18Y, 18C, 18M, and 18K is detected, and a timing of environmental change at which environmental change from the previous first detection process exceeds a threshold.

At the initial startup timing and the timing of environmental change, the controller 110 generates the first pattern data for photoconductor cycle and the first pattern data for sleeve cycle, for each of yellow, cyan, magenta, and black. In contrast, in the replacement detection timing, only for the image forming unit 18 of which replacement is detected, the controller 110 generates the first pattern data for photoconductor cycle and the first pattern data for sleeve cycle. To enable the generation of pattern, as illustrated in FIGS. 7A and 7B, the copier 500 includes the unit mount sensors 17Y, 17C, 17M, and 17K to individually detect the replacement of the image forming units 18Y, 18C, 18M, and 18K.

The controller 110 according to the present embodiment uses the amount of change in absolute humidity as the environmental change. The controller 110 calculates the absolute humidity based on temperature detected by the environment sensor 124 and relative humidity detected by the environment sensor 124. The absolute humidity calculated in the previous pattern process is stored. Subsequently, the controller 110 regularly calculates the absolute humidity based on the detection results on temperature and humidity, detected by the environment sensor 124. When the difference (environmental change amount) between the calculated value and the stored absolute humidity exceeds the threshold, the controller 110 executes the first detection process and the first pattern data generation process.

Figure 12:
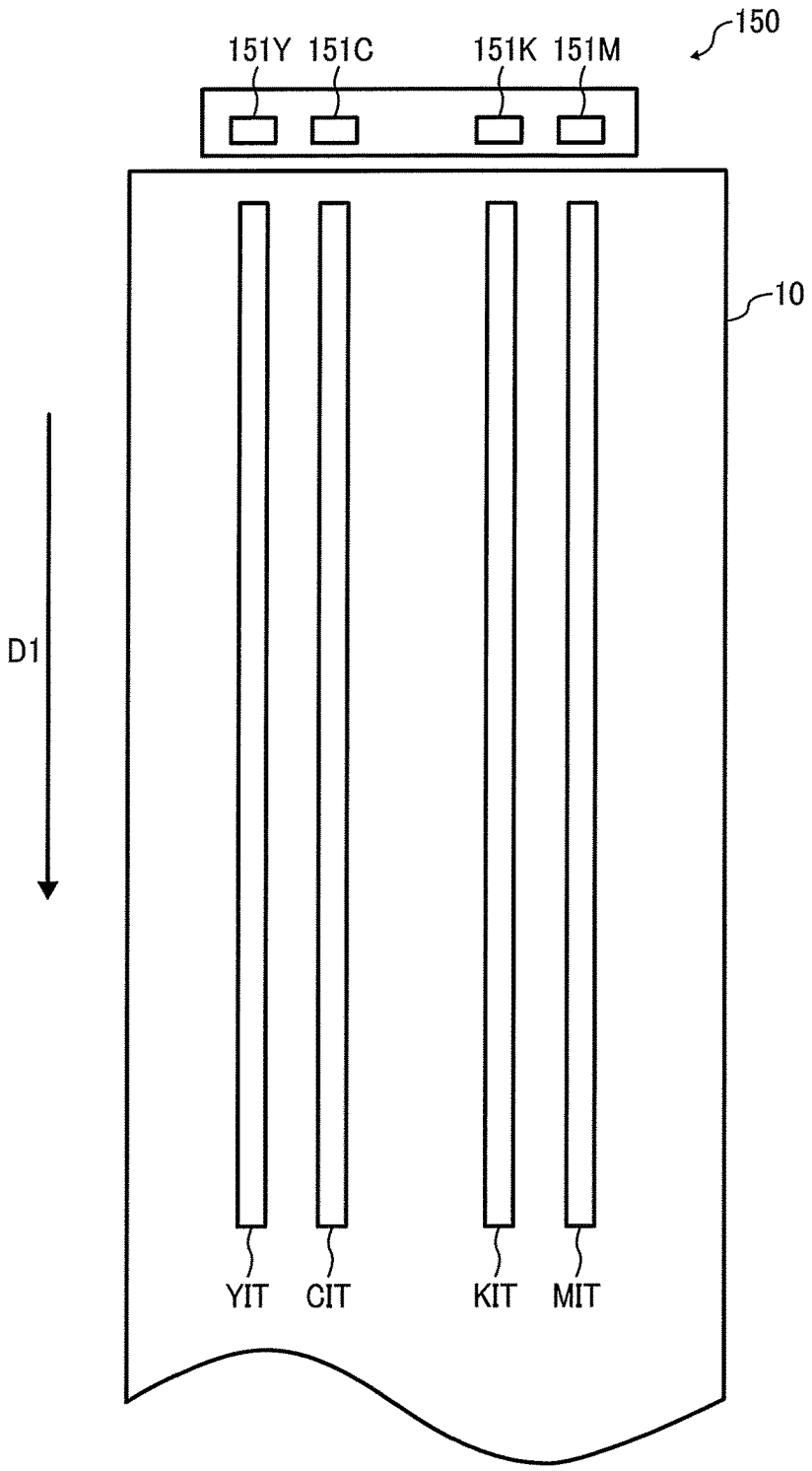
FIG. 12 is a schematic plan view of a first test image of each color on the intermediate transfer belt, according to an embodiment.

In the first detection process at the initial startup timing, initially, a first test image for yellow, which is a solid toner image, is formed on the photoconductor 20Y. In addition, a first test image for cyan, a first test image for magenta, and a first test image for black, which are respectively cyan, magenta, and black solid toner images, are formed on the photoconductor 20C, the photoconductor 20M, and the photoconductor 20K. Then, first test images YIT, CIT, MIT, and KIT are primarily transferred onto the intermediate transfer belt 10, as illustrated in FIG. 12. In FIG. 12, since the first test image YIT is used to detect the yellow image density fluctuation in the rotation cycle of the photoconductor 20Y, the first test image YIT is longer than the length of circumference (in the direction of arc) of the photoconductor 20Y in the belt travel direction indicated by arrow D1 in FIG. 12. Likewise, the first test images CIT, MIT, and KIT for cyan, magenta, and black are longer than the lengths of circumference of the photoconductors 20C, 20M, and 20K, respectively.

In FIG. 12, for convenience, four toner images, that is, the first test images YIT, CIT, MIT, and KIT are aligned in the belt width direction to detect the density unevenness. In practice, however, there are cases where the positions of the first test images of different colors on the belt may be shifted from each other, at most, by an amount equivalent to the length of circumference of the photoconductor 20. This is because, for each color, formation of the first test image is started to match a leading end position of the first test image with a reference position on the photoconductor 20 (photoconductor surface position entering the developing range at the reference attitude timing) in the direction of circumference of the photoconductor 20. That is, the first test image for each color is formed such that the leading end thereof matches the reference position of the photoconductor 20 in the direction of circumference.

Instead of a solid toner image, a halftone toner image may be formed as the first test image. For example, a halftone toner image having a dot coverage of 70% may be formed.

The controller 110 executes the first detection process and the process control together as a set. Specifically, immediately before the first detection process, the controller 110 executes the process control to determine the developing bias reference value for each color. In the first detection process executed immediately after the process control, the controller 110 develops, for each color, the first test image with the developing bias reference value determined by the process control. Accordingly, logically, the first test image is developed to have the target toner adhesion amount. However, actually, minute density unevenness occurs due to the gap fluctuation.

The time lag between the start of formation of the first test image (writing of the electrostatic latent image) and the arrival of the leading end of the first test image at a detection position by the reflective photosensor of the optical sensor unit 150 is different among the four colors. However, in the case of the same color, the time lag between writing and detection is constant over time, which is hereinafter referred to as "writing-detection time lag."

The controller 110 preliminarily stores the writing-detection time lag, for each color, in the nonvolatile memory. For each color, sampling of output from the reflective photosensor starts after the writing-detection time lag has passed from the start of formation of the first test image. This sampling is repeated at predetermined intervals throughout one rotation cycle of the photoconductor 20. The interval is identical to the interval of reading of each data in the first pattern data used in the first fluctuation control. The controller 110 generates, for each color, a density unevenness graph indicating the relation between the toner adhesion amount (image density) and time (photoconductor surface position), based on the sampling data. From the density unevenness graph, the controller 110 extracts two fluctuation patterns of solid image density: (1) the fluctuation pattern of solid image density occurring in photoconductor rotation cycle, and (2) the fluctuation pattern of solid image density occurring in sleeve rotation cycle.

After extracting the fluctuation pattern of solid image density in photoconductor rotation cycle and sleeve rotation cycle based on the sampled data for each color, the controller 110 executes the first pattern data generation process. In the first pattern data generation process, the controller 110 calculates an average toner adhesion amount (or an average image density) of the first test image. The average toner adhesion amount substantially reflects an average of the variation of the development gap in one rotation cycle of the photoconductor. Therefore, with respect to the average toner adhesion amount, the controller 110 generates the first pattern data for photoconductor cycle to offset the fluctuation pattern of solid image density in photoconductor rotation cycle. Specifically, the controller 110 calculates the bias output differences individually corresponding to a plurality of data values of toner adhesion amount included in the solid image density pattern. The bias output differences are based on the average toner adhesion amount. The bias output difference corresponding to the toner adhesion amount data identical in value to the average toner adhesion amount is calculated as zero.

The bias output difference corresponding to the toner adhesion amount data larger in value than the average toner adhesion amount is calculated as a positive value corresponding to the difference between that toner adhesion amount and the average toner adhesion amount. Being a plus value, this bias output difference changes the developing bias, which is negative in polarity, to a value lower (smaller in absolute value) than the developing bias reference value.

In addition, the bias output difference corresponding to the toner adhesion amount data smaller in value than the average toner adhesion amount is calculated as a negative value corresponding to the difference between that toner adhesion amount and the average toner adhesion amount. Being a minus value, this bias output difference changes the developing bias, which is negative in polarity, to a value higher (larger in absolute value) than the developing bias reference value. Thus, the controller obtains the bias output difference corresponding to each toner adhesion amount data and generates the first pattern data for photoconductor cycle, in which the obtained bias output differences are arranged in order.

In addition, after extracting, for each color, the fluctuation pattern of solid image density in sleeve rotation cycle based on the sampling data, the controller 110 calculates an average toner adhesion amount (average image density). The average toner adhesion amount substantially reflects an average of the variation of the development gap in one rotation cycle of the developing sleeve. Therefore, with respect to the average toner adhesion amount, the controller 110 generates the first pattern data for sleeve cycle to offset the fluctuation pattern of solid image density in sleeve rotation cycle. The first pattern data for sleeve cycle can be generated through process similar to the process to generate the first pattern data for photoconductor cycle to offset the solid image density fluctuation in photoconductor rotation cycle.

Figure 13:
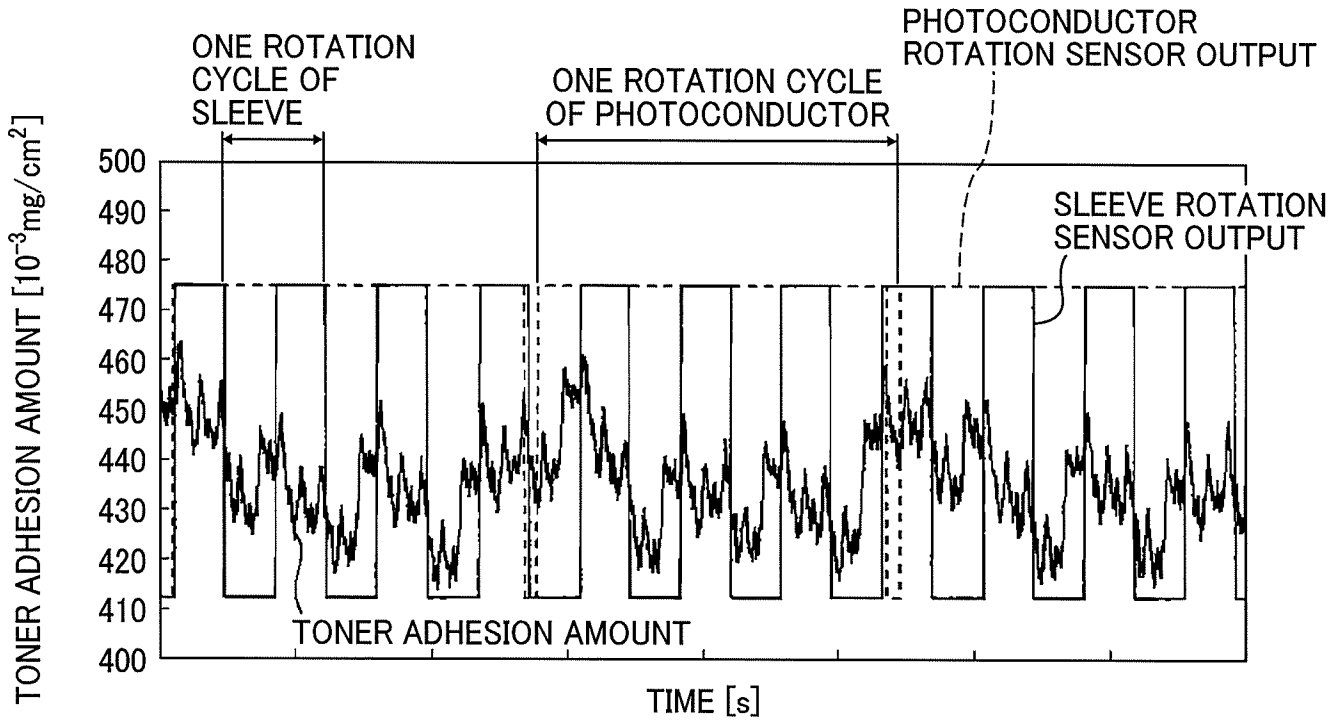
FIG. 13 is a graph illustrating a relation between cyclic fluctuations in the toner adhesion amount of the first test image, output from a sleeve rotation sensor, and output from the photoconductor rotary sensor.

FIG. 13 is a graph illustrating a relation between cyclic fluctuations in the toner adhesion amount of the first test image, output from a sleeve rotation sensor, and output from the photoconductor rotary sensor. The vertical axis of the graph represents the toner adhesion amount in $10^3$ mg/cm$^2$, which is obtained by converting the output voltage from the reflective photosensor 151 of the optical sensor unit 150 according to a predetermined conversion formula. It is understood that the image density of the first test image exhibits cyclical fluctuation pattern in the travel direction of the intermediate transfer belt 10.

Figure 14:
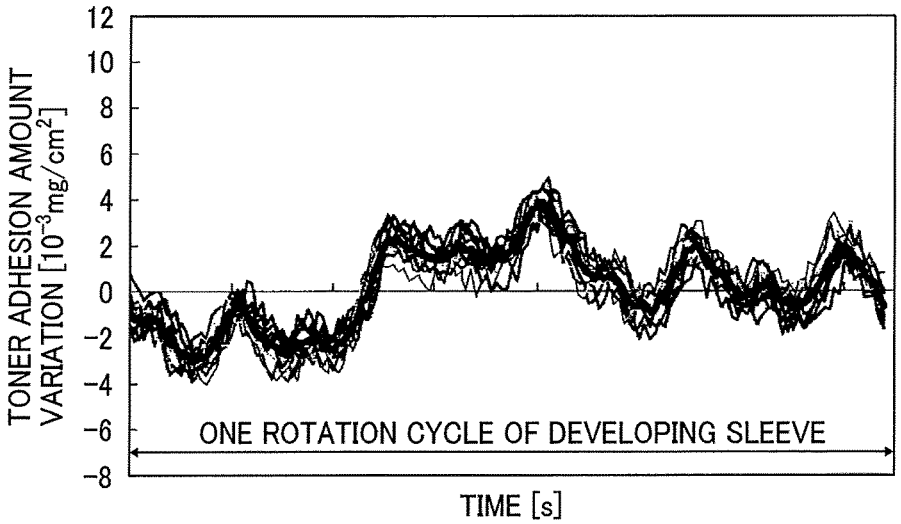
FIG. 14 is a graph illustrating an average waveform.

In generating the first pattern data (developing variation pattern) for sleeve cycle, initially, in order to remove the cyclic fluctuation components different from those of sleeve cycle, the controller 110 takes out data on fluctuation with time of toner adhesion amount per sleeve rotation cycle and performs averaging. Specifically, the length of the first test image is at least ten times longer than the length of circumference of the developing sleeve 81. Accordingly, the data on fluctuation with time of toner adhesion amount is obtained for a period equivalent to ten times or more of sleeve rotation cycle. Based on this data, a fluctuation waveform starting from the sleeve reference attitude timing is cut out for each sleeve rotation cycle. Thus, ten fluctuation waveforms are cutout. Subsequently, as illustrated in FIG. 14, the cutout waveforms are superimposed, with the sleeve reference attitude timings thereof synchronized with each other, and averaged. Then, the average waveform is analyzed.

The average waveform obtained by averaging the ten cutout waveforms is indicated by a thick line in FIG. 14. The individual cutout waveforms include cyclic fluctuation components deviating from those in the sleeve rotation cycle and are not smooth. By contrast, in the average waveform, deviation is reduced. In the copier according to the present embodiment, averaging is performed as to ten cutout waveforms; however, another method may be used as long as the sleeve rotation cycle variation components can be extracted.

Figure 15:
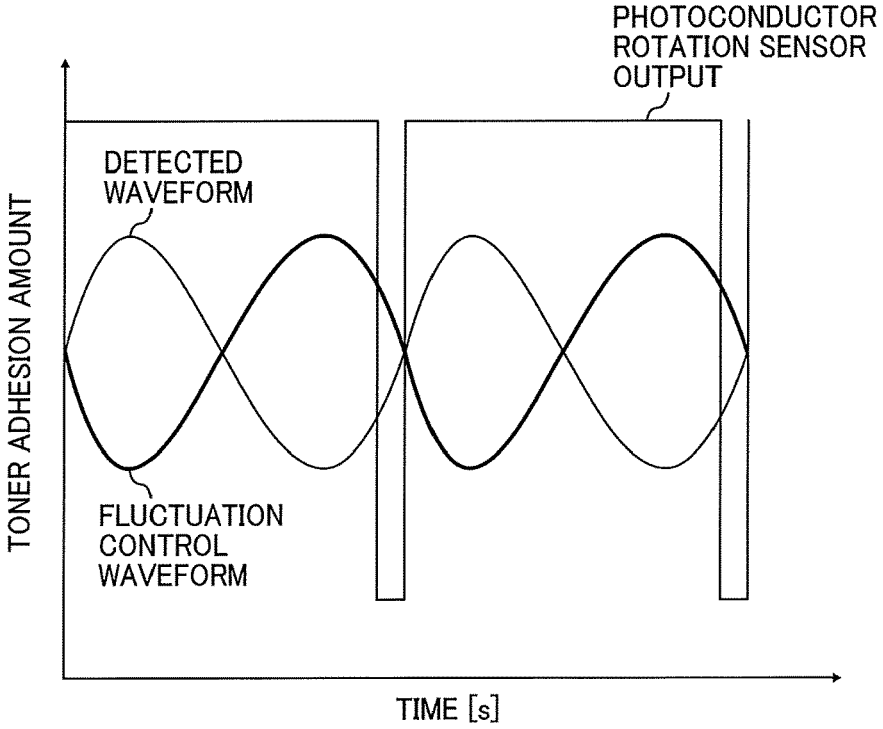
FIG. 15 is a graph illustrating an algorithm used in generating developing-bias change pattern, according to an embodiment.

Similar to the first pattern data for sleeve cycle, the controller 110 generates the one for photoconductor cycle based on the result of averaging of the waveforms cutout per photoconductor rotation cycle. To generate the first pattern data based on the average waveform, the toner adhesion amounts are converted into developing bias variations using, for example, an algorithm that changes the developing bias to draw a fluctuation control waveform reverse in phase to the detected waveform of the toner adhesion amount illustrated in FIG. 15.

Figure 16:
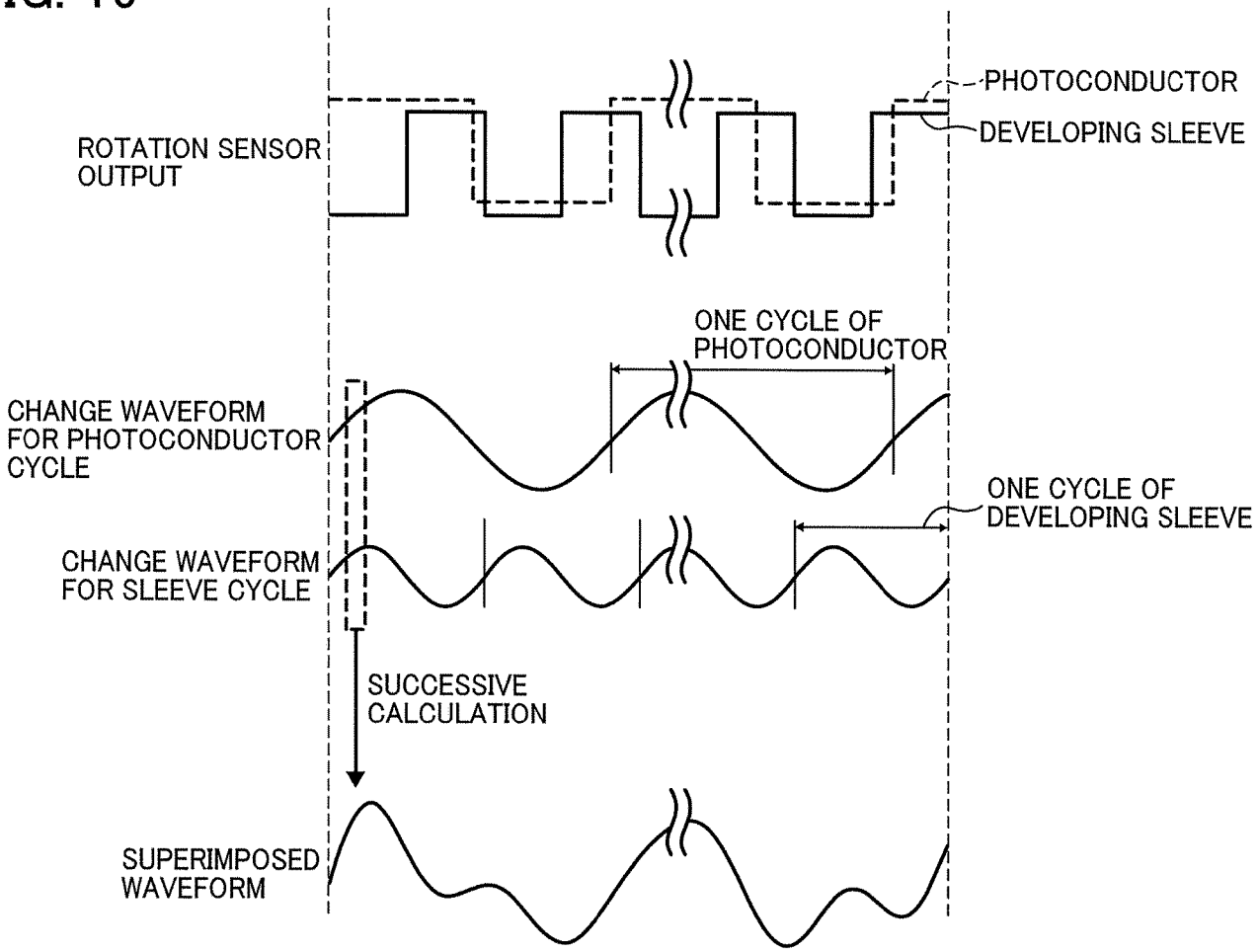
FIG. 16 is a timing chart illustrating each output timing in image formation, according to an embodiment.

As described above, for each color, the output of developing bias Vb from the developing power supply 11Y, 11C, 11M, and 11K is varied, using the first pattern data for photoconductor cycle and the first pattern data for sleeve cycle generated in the first pattern data generation process. More specifically, as illustrated in FIG. 16, the developing bias is cyclically changed in accordance with the superimposed waveform in which the waveform of variation based on the first pattern data for photoconductor rotation cycle and the waveform of variation based on the first pattern data for sleeve cycle are superimposed. As a result, the image density fluctuation occurring in the photoconductor rotation cycle or that occurring in the sleeve rotation cycle can be suppressed.

Figure 17:
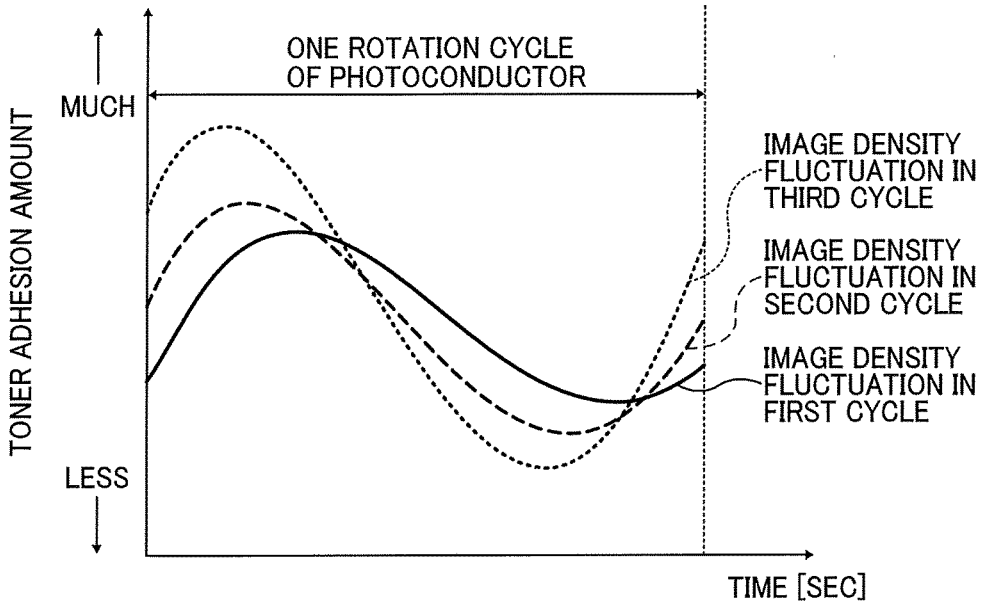
FIG. 17 is a graph illustrating a measurement error of toner adhesion amount.

The image density fluctuation in the photoconductor rotation cycle includes measurement errors due to various factors as illustrated in FIG. 17. In FIG. 17, the phases and the amplitudes in the image density fluctuations of periods do not match. The image density fluctuation in the sleeve rotation cycle also includes similar measurement errors. When the first pattern data for the photoconductor rotation cycle and the first pattern data for the sleeve rotation cycle are generated from the image density fluctuation including big measurement errors described above, the first fluctuation control based on the first pattern data may increase the image density fluctuation. Therefore, after execution of the first detection process, and before execution of the first pattern data generation process, the controller 110 executes a determination process to determine whether the first fluctuation control should be executed.

At the beginning of the determination process, the controller 110 calculates amplitudes A1, A2, and A3 with phases θ1, θ2, and θ3, respectively, for each of the waveforms cutout per photoconductor rotation cycle (waveform data of the image density fluctuation data). The calculations may be performed by using orthogonal waveform detection processing or fast Fourier transform (FFT) process.

The controller 110 stores the calculated data including the amplitudes A1, A2, A3, . . . and the phases θ1, θ2, θ3, . . . corresponding to a plurality of cycles. The controller 110 calculates a variation σ1 in the amplitudes A1, A2, A3, . . . of the plurality of cycles and a variation σ72 in the phases θ1, θ2, θ3, . . . of the plurality of cycles. In the example as illustrated in FIG. 17, when the image density fluctuation for one rotation cycle of the photoconductor is set as one measurement unit, the controller 110 calculates variations σ1 and σ2 from the image density fluctuation data (i.e., the amplitude and the phase data) measured three times. However, the controller 110 may set the image density fluctuation of a plurality of rotation cycles of the photoconductor as one measurement unit, and calculate variations σ1 and σ2 in the image density fluctuation data (i.e., the amplitude and the phase data) of a plurality of rotation cycles of the photoconductor measured a plurality of times. For example, from the toner adhesion amount detection results of the first to third photoconductor cycles, a first set of the amplitude data A1 and the phase data θ1 is calculated by using the direct wave detection processing. Similarly, from the toner adhesion amount detection result of the fourth to sixth rotation cycles of the photoconductor, a second set of the amplitude data A2 and the phase data θ2 is calculated, and the above calculation operation is repeated so that multiple image density fluctuation data (A1, A2, A3, . . . , θ1, θ2, θ3, . . . ) may be obtained. In this case, the image density fluctuation data with higher precision may be obtained. However, because the length of the toner pattern in the sub-scanning direction needs to be extended, there is disadvantage due to the longer processing time and increased toner consumption amount.

As the image density fluctuation data, the controller 110 may use output signals of the reflective photosensor or the data converted into the toner adhesion amounts from the output signals of the reflective photosensor.

The variation σ1 among the amplitude data A1, A2, A3, . . . , of multiple cycles may be defined as follows. For example, difference between each amplitude data (|A1−A2|, |A1−A3|, |A2−A3|, . . . ) is calculated, and the maximum value may be defined as the variation σ1. Otherwise, for example, deviation from an average value of the amplitude data, or dispersion or standard deviation may be used as the variation σ1. As to the variation σ2 among the phase data θ1, θ2, θ3, . . . , of multiple cycles, the same definition may be used.

The controller 110 compares the thus-obtained variations σ1 and σ2 with the preset thresholds in the determination process. If both the variation σ1 of the amplitude and the variation σ2 of the phase are less than or equal to each corresponding threshold, the controller 110 calculates variations σ1 and σ2 for the waveforms cutout per the sleeve rotation cycle similarly. If both the variation σ1 of the amplitude and the variation σ2 of the phase for the sleeve rotation cycle are less than or equal to each corresponding threshold, the controller 110 determines execution of the first fluctuation control.

On the other hand, if any one of the variations σ1 and σ2 in the image density fluctuation of the photoconductor rotation cycle and the variations σ1 and σ2 in the image density fluctuation of the sleeve rotation cycle exceeds the corresponding threshold, the controller 110 determines not to execute the first fluctuation control.

Above described control avoids deterioration of a cyclical image density fluctuation caused by the execution of the first fluctuation control using unsuitable first pattern data. Alternatively, the controller 110 may determine to execute the first fluctuation control if all of the variations σ1 and σ2 in the image density fluctuation of the photoconductor rotation cycle and the sleeve rotation cycle are less than each corresponding threshold, and not executing the first fluctuation control if any one of these variations σ1 and σ2 are equal to or more than the corresponding threshold.

Instead of the determination of the execution of the first fluctuation control based on the variation of the image density fluctuation for rotation cycles, the controller 110 may execute the following determination process. The controller 110 may execute the first pattern data generation process based on the data from the first test image and may generate the first pattern data. Subsequently, the controller 110 may form the first test image again based on the first pattern data, and determine whether the first pattern data generation process should be executed based on a variation of an image density fluctuation derived from detection of the first test image formed again. Hereinafter the case when the variations σ1 and σ2 for the photoconductor rotation cycles and for the sleeve rotation cycles are less than the corresponding threshold, or equal to or less than the corresponding threshold is called a small variation case. The opposite case is called a big variation case.

Next, a feature of the copier 500 according to the embodiment is described below. The copier 500 according to the embodiment executes a second fluctuation control and a third fluctuation control in addition to the first fluctuation control when they are needed in the image forming process. In the second fluctuation control, the controller 110 generates a second pattern data for the photoconductor cycle and that for the sleeve cycle and cyclically changes a charging bias based on the second pattern data. In the third fluctuation control, the controller 110 generates a third pattern data for the photoconductor cycle and that for the sleeve cycle and cyclically changes the LD power of the laser writing device 21 (writing power) based on the third pattern data.

The reason why the controller 110 executes the second fluctuation control is as follows. In an image including a solid portion and a halftone portion, the image density of the solid portion is greatly affected by the developing potential being the difference between the developing bias Vb and the latent image potential V1 that is the potential of the electrostatic latent image. By contrast, the image density of the halftone portion may be greatly affected by the background potential that is the difference between the charged potential Vd of the photoconductor and the developing bias Vb, compared with the developing potential. Specifically, in the solid portion, the periphery of each dot is overlapped with the peripheries of adjacent dots. That is, there is no isolated dot. By contrast, the halftone portion includes isolated dots or a small number dot group that is a set of a small number of dots. The isolated dot and the small number dot group are greatly affected by an edge effect than the solid portion. Accordingly, when the background potential is identical between the solid portion and the halftone portion, the force of adhesion to the photoconductor is stronger in the halftone portion than in the solid portion, and the halftone portion is less affected by the gap fluctuation. Further, the toner adhesion amount per unit area in the halftone portion is greater than the one in the solid portion. Accordingly, a fluctuation of the toner adhesion amount in the halftone portion caused by the gap fluctuation are smaller than the one in the solid portion. When the developing bias Vb is changed using the superimposed output pattern generated based on the first test image that is the solid toner image, the image density fluctuation in the solid portion can be suppressed. However, in the halftone portion, overcorrection occurs. The overcorrection results in the image density fluctuation in the halftone portion.

Since the edge effect is heavily affected by the background potential, the background potential may be adjusted to adjust the above-described overcorrection. The adjustment of the background potential is performed by changing the charging bias that results in a change of the charged potential Vd.

After the controller 110 generates the first pattern data for photoconductor cycle and that for sleeve cycle, which individually corresponds to each of yellow, cyan, magenta, and black, the controller 110 executes the second detection process.

In the second detection process, the controller 110 forms a yellow second test pattern that is a yellow half tone toner image on the photoconductor 20Y. In addition, a second test image for cyan, a second test image for magenta, and a second test image for black, which are respectively cyan, magenta, and black halftone toner images, are formed on the photoconductor 20C, the photoconductor 20M, and the photoconductor 20K, respectively. When the controller 110 forms the second test images, the controller 110 changes the developing bias Vb based on the developing bias reference value, the first pattern data for photoconductor cycle, the photoconductor reference attitude timing, the first pattern data for sleeve cycle, and the sleeve reference attitude timing. Such conditions suppress the image density fluctuation in the solid portion corresponding to the photoconductor rotation cycle and the sleeve rotation cycle, but causes the image density fluctuation in the halftone portion that are the four second test images described above due to the overcorrection of the developing bias Vb. To detect the image density fluctuation, the controller 110 samples the outputs from the four reflective photosensors 151 of the optical sensor unit 150 at predetermined intervals for a period equal to or longer than one rotation cycle of the photoconductor 20. Subsequently, the controller 110 extracts a pattern of the image density fluctuation occurring in the photoconductor rotation cycle, based on the sampled data obtained for each color.

Next, the controller 110 extracts a pattern of the image density fluctuation in the sleeve rotation cycle based on the above described sampled data for each color.

After the second detection process, the controller 110 executes the second pattern data generation process if needed. In the second pattern data generation process, the controller 110 calculates an average toner adhesion amount (or an average image density) of the second test image based on the pattern of the image density fluctuation occurring in the photoconductor rotation cycle. Thereafter, the controller 110 generates the second pattern data that changes the charging bias with reference to the average toner adhesion amount in the photoconductor rotation cycle to offset the pattern of the image density fluctuation of the halftone portion occurring in the photoconductor rotation cycle. Specifically, the controller 110 calculates the bias output differences individually corresponding to a plurality of toner adhesion amounts that are included in the pattern of the image density fluctuation occurring in the photoconductor rotation cycle. The bias output differences are calculated with reference to the average toner adhesion amount. The bias output difference corresponding to the average toner adhesion amount is calculated as zero. The bias output difference corresponding to the toner adhesion amount more than the average toner adhesion amount is calculated as a negative value corresponding to the difference between that toner adhesion amount and the average toner adhesion amount. Being a minus value, this bias output difference changes the charging bias, which is negative in polarity, to a value higher (larger in absolute value) than the charging bias reference value. In addition, the bias output difference corresponding to the toner adhesion amount less than the average toner adhesion amount is calculated as a plus value corresponding to the difference between that toner adhesion amount and the average toner adhesion amount. Being a plus value, this bias output difference changes the charging bias, which is negative in polarity, to a value lower (smaller in absolute value) than the charging bias reference value. Thus, the controller 110 obtains the bias output differences individually corresponding to the plurality of toner adhesion amounts and generates the second pattern data for photoconductor cycle, in which the obtained bias output differences are arranged in order.

Next, the controller 110 generates the second pattern data for sleeve rotation cycle to offset the pattern of image density fluctuation in the sleeve rotation cycle. The controller 110 generates the second pattern data through process similar to the process to generate the second pattern data for the photoconductor cycle.

After that, ordinal numbers of individual data values in the second pattern data for the photoconductor cycle are shifted by a predetermined number. Specifically, the leading data in the second pattern data for photoconductor cycle corresponds to, of an entire surface of the photoconductor 20, a photoconductor surface position entering the developing range when the photoconductor 20 takes the reference rotation attitude. The position is charged in not the developing range but the area of contact between the charging roller 71Y and the photoconductor 20Y. Since it takes time (i.e., time lag) for the photoconductor surface to move from the charging contact position to the developing range, the position of each data is shifted by a number corresponding to the time lag. For example, when the pattern data includes 250 data values, positions of the first to 230th data values are shifted by 20, and the 231st data value to the 250th data value are changed to the first to 20th data. Regarding the second pattern data for sleeve cycle, the positions of the data values are similarly shifted by a predetermined number.

When an image is formed in response to a command from a user, outputs of the developing bias Vb from the developing power supplies are changed based on the first pattern data for the photoconductor cycle and the first pattern data for the sleeve cycle formulated in the first pattern data generation process, for each color. Specifically, the controller 110 generates the superimposed output pattern data (data to reproduce the superimposed waveform) based on the first pattern data for photoconductor cycle, the photoconductor reference attitude timing, the first pattern data for sleeve cycle, and the sleeve reference attitude timing. Subsequently, the controller 110 changes the output value of the developing bias Vb based on the superimposed output pattern and the developing bias reference value. This process suppress the image density fluctuation of the solid portion occurring in the photoconductor rotation cycle and the sleeve rotation cycle.

In parallel to changing the developing bias as described above, the controller 110 changes the output of the charging bias from the charging power supply 12 based on the second pattern data for photoconductor cycle and that for sleeve cycle that are generated in the second pattern data generation process. Specifically, the controller 110 generates the superimposed output pattern data based on the second pattern data for photoconductor cycle, the photoconductor reference attitude timing, the second pattern data for sleeve cycle, and the sleeve reference attitude timing. Subsequently, the controller 110 changes the output value of the charging bias from the charging power supply 12 based on the superimposed output pattern data and the charging bias reference value that has been determined in the process control. This process suppress the image density fluctuation of the half-tone portion in the photoconductor rotation cycle or the sleeve rotation cycle due to the overcorrection of the developing bias Vb.

However, even by cyclically changing the developing bias and the charging bias, the cyclical image density fluctuation still remain. Such cyclic density fluctuation is hereinafter called as "residual cyclic fluctuation." Cyclically changing the charging bias based on the second pattern data causes the residual cyclic fluctuation.

Figure 18:
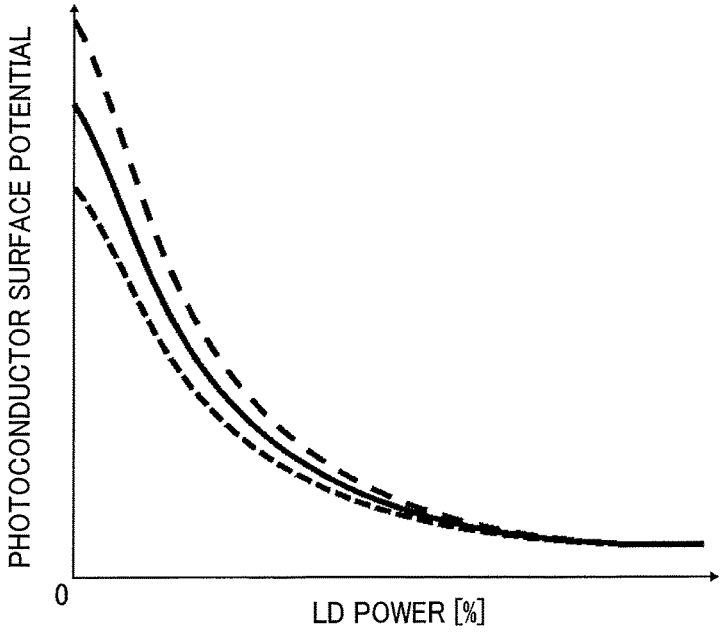
FIG. 18 is a graph illustrating relations among a charged potential (a potential of a background portion in an entire area of the photoconductor uniformly charged by the charging device), the electrostatic latent image potential attained by optical writing on the background portion, and the LD power (%) in the optical writing.

FIG. 18 is a graph illustrating relations among the charged potential (potential of a background portion uniformly charged by the charging device, out of the entire area of the photoconductor), the electrostatic latent image potential attained by optical writing on the background portion, and the LD power (%) in the optical writing. In FIG. 18, the charged potential is the surface potential of the photoconductor 20 corresponds to an LD power of 0%, and the latent image potential corresponds to an LD power greater than 0%. The optical writing on the background portion causes attenuation of the surface potential of the photoconductor corresponding to the LD power. A region of the photoconductor where the surface potential attenuates becomes the latent image. As illustrated in FIG. 18, light attenuation characteristics changes depending on the charged potential of the photoconductor (values corresponding to LD power=0%). Therefore, when the charging bias is cyclically changed based on the second pattern data, the charged potential of the photoconductor is cyclically changed accordingly, this cyclical fluctuation changes a potential of the latent image on the photoconductor cyclically. A cyclical image density fluctuation caused by the cyclical fluctuation of the potential of the latent image is the residual cyclic fluctuation caused by the cyclical changed charging bias.

To restrict the width of residual cyclic fluctuation to a certain amount, in the formula for obtaining LD power LDi' to be described later, for the amount by which the charging bias Vci exceeds a threshold voltage Vmax, the copier 500 according to the present embodiment adds the following value to the LD power Ldi. That is, what added is the value corresponding to the difference between the threshold voltage Vmax and the charging bias Vci, which will be described in detail later.

Before execution of the third pattern data generation process that generates third pattern data to change the LD power cyclically, the controller 110 executes a third detection process. In the third detection process, firstly, while cyclically changing the developing bias Vb based on the first pattern data generated in advance, the controller 110 cyclically changes the charging bias Vc based on the second pattern data generated in advance, to thereby form a third test image that is a solid toner image. The reflective photosensor 151 detects an image density fluctuation (a residual cyclic fluctuation) of the third test image. The controller 110 executes a frequency analysis for the detected residual cyclic fluctuation and extracts a residual cyclic fluctuation in the photoconductor rotation cycle and a residual cyclic fluctuation in the sleeve rotation cycle.

After detecting the residual cyclic fluctuation in the third detection process, the controller 110 executes the third pattern data generation process when the third pattern data generation process is needed. In the third pattern data generation process, the controller 110 generates the third pattern data for photoconductor cycle and that for sleeve cycle. Specifically, the controller 110 generates, as the third pattern data, a formula: $\Sigma Ldi' \times \sin(i \times \omega t + \theta i)$ in which an amplitude Ldi' calculated based on the amplitude Ai of sine wave regarding the residual cyclic fluctuation is substituted. This formula is hereinafter referred to as "third pattern formula."

In the third pattern data generation process, the controller 110 assigns each data of the residual cyclic fluctuation in the photoconductor rotation cycle and the residual cyclic fluctuation in the sleeve rotation cycle to a predetermined conversion algorithm and generates a tentative third pattern data for photoconductor cycle and that for sleeve cycle. The conversion algorithm converts each of a plurality of image density values included in the residual cyclic fluctuation into a LD power value that gives a desired image density based on an experiment that use a predetermined charging bias and a predetermined LD power. Based on the conversion algorithm, the controller 110 converts each of a plurality of image density values included in the residual cyclic fluctuation into a LD power value and generates the third pattern data including a plurality of LD power values. The third pattern data is the formula: $\Sigma Ldi \times \sin(i \times \omega t + \theta i)$ in which an amplitude Ldi calculated based on the amplitude Ai of the residual cyclic fluctuation regarding the halftone image density unevenness is substituted.

In the third fluctuation control, the controller 110 calculates each of LD powers Ldi (i=1 to x) based on the third pattern data (the third pattern formula). The controller 110 normalizes the results of such calculation with the predetermined reference value to generate a group of data. Subsequently, the controller 110 cyclically changes the LD power based on the group of data. Such cyclic change of the LD power makes it possible to suppress the residual cyclic fluctuation.

Now, put the case that the big variation of any one of the variations σ1 and σ2 in the image density fluctuation detected in the first detection process leads to determination of not executing the first fluctuation control with the image forming process in the determination process. Additionally, put the case that the variations σ1 and σ2 in the image density fluctuation detected in the second detection process are less than the thresholds. In such a case, if the controller 110 determines not to execute the first fluctuation control and execution of the second fluctuation control in the determination process, the cyclical image density fluctuation of the halftone portion becomes worth compared with the case that the controller 110 determines not to execute both the first fluctuation control and the second fluctuation control.

Specifically, the second fluctuation control is executed to suppress the cyclical image density fluctuation of the halftone portion due to the variation of the background potential caused by the cyclical change of the developing bias in the first fluctuation control. In the case that the first fluctuation control is not executed, that is, in the case that the developing bias is not changed cyclically, the cyclical variation of the background potential caused by the cyclical change of the developing bias does not occur. Therefore, without changing the charging bias cyclically, keeping the charging bias constantly makes it possible to keep the background potential within a constant range. An execution of only the second fluctuation control causes the cyclical variation of the background potential due to the cyclical change of the charging bias. The cyclical variation of the background potential causes the cyclical image density fluctuation of the halftone potion. Thus, the cyclical image density fluctuation of the halftone potion deteriorates.

Now, put the case that the small variations σ1 and σ2 in the image density fluctuation detected in the first detection process leads to determination of execution of the first fluctuation control in parallel with the image forming process in the determination process. Additionally, in case either the variations σ1 or the variations σ2 in the image density fluctuation detected in the second detection process is more than the corresponding threshold, if the controller 110 determines execution of the first fluctuation control and skipping of the second fluctuation control in the determination process, the cyclical image density fluctuation of the halftone portion occurs because execution of only the first fluctuation control results in the cyclical variation of the background potential. That is, the cyclical image density fluctuation of the halftone portion occurs in an image including the solid portion and the halftone portion and an image including only the halftone portion and not including the solid portion (hereinafter such images are called a halftone reproduction image). Because the cyclical image density fluctuation of the halftone portion is more noticeable than the cyclical image density fluctuation of the solid portion, the execution of only the first fluctuation control out of the first and second fluctuation controls makes the image quality worse, as compared with the case where the controller 110 determines not to execute both the first and the second fluctuation controls.

Therefore, the controller 110 handles the first and second fluctuation control as a set in the determination process and always determines whether the controller 110 executes the set of the two controls. Above described control avoids occurrence of the cyclical image density fluctuation of the halftone portion caused by the execution of only the second fluctuation control and a bad image quality of the halftone reproduction image caused by the execution of only the first fluctuation control.

Figure 19:
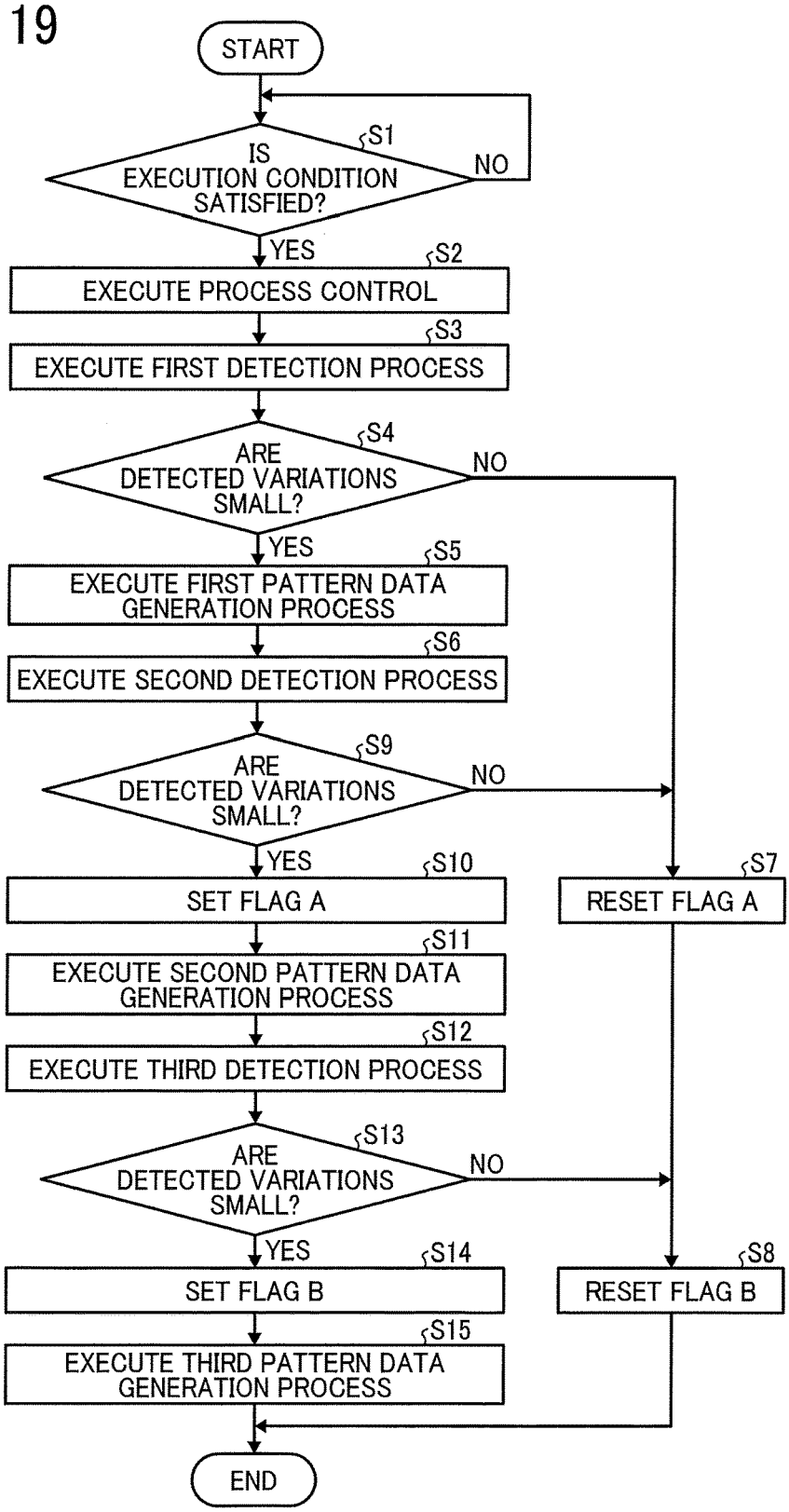
FIG. 19 is a flowchart illustrating steps in a process of a regular adjustment control performed by a controller of the copier.

FIG. 19 is a flowchart illustrating steps in a process of a regular adjustment control performed by the controller 110. When an execution condition is satisfied in the regular adjustment control (Yes in step S1), the controller 110 executes the process control (step S2). After the process control, the controller 110 executes the first detection process (step S3). Subsequently, the controller 110 determines whether either the variations σ1 or the variations σ2 in the image density fluctuation detected in the first detection process is smaller than the corresponding threshold (step S4). When either the variations σ1 or the variations σ2 is equal to or greater than the corresponding threshold (No in step S4), the first fluctuation control based on the first pattern data generated from the image density fluctuation with the great variation may increase the cyclical image density fluctuation of the solid portion. Therefore, in such a case, the controller 110 terminates the sequential process flow after resets of a flag A and a flag B (step S7 and step S8).

The flag A is a parameter to illustrate whether the first fluctuation control and the second fluctuation control should be executed in parallel with the image forming process executed after the regular adjustment control. Set of the flag A means the controller 110 determines the execution of the two fluctuation controls. In contrast, reset of the flag A means the controller 110 determines not to execute the first and second fluctuation controls.

The flag B is a parameter to illustrate whether the third fluctuation control should be executed in parallel with the image forming process executed after the regular adjustment control. Set of the flag B means the controller 110 determines the execution of the third fluctuation control. In contrast, reset of the flag B means the controller 110 determines not to execute the third fluctuation controls.

When either the variations σ1 or the variations σ2 in the image density fluctuation detected in the first detection process is equal to or greater than the corresponding threshold (No in step S4), the controller 110 resets the flag A in step S7 and does not execute the first fluctuation control and the second fluctuation control. This arrangement has the following advantage. That is, this control avoids the occurrence of the cyclical image density fluctuation of the halftone portion caused by the execution of only the second fluctuation control out of the first and second fluctuation control.

When the flag A is reset in step S7, the residual cyclic fluctuation (described above) does not occur in the subsequent image forming process. So, the third fluctuation control is not needed to decrease the residual cyclic fluctuation. Therefore, in such a case, the controller 110 also resets the flag B (step S8) and terminates the sequential process flow.

On the other hand, when the variations σ1 and σ2 in the image density fluctuation detected in the first detection process are less than the corresponding threshold (Yes in step S4), it is possible to generate a suitable first pattern data based on the image density fluctuation. The controller 110 executes the first pattern data generation process (step S5) to generate the first pattern data for photoconductor cycle and the one for sleeve cycle. Subsequently, the controller 110 executes the second detection process (step S6) to obtain the image density fluctuation of the second test image and determines whether either the variations σ1 or the variations σ2 in the image density fluctuation detected in the second detection process is smaller than the corresponding threshold (step S9).

When either the variations σ1 or the variations σ2 in the image density fluctuation of the second test image process is equal to or greater than the corresponding threshold (No in step S9), the second fluctuation control based on the second pattern data generated from the image density fluctuation with the great variation may increase the cyclical image density fluctuation of the halftone portion. Therefore, in such a case, the controller 110 resets the flag A and the flag B (step S7 and step S8) and terminates the sequential process flow. Above described control avoids deterioration of a cyclical image density fluctuation of the halftone portion caused by the execution of the second fluctuation control using unsuitable second pattern data. Additionally, not executing the first fluctuation control avoids a bad image quality of the halftone reproduction image caused by the execution of only the second fluctuation control out of the first and second fluctuation control.

On the other hand, when the variations σ1 and σ2 in the image density fluctuation of the second test image is less than the corresponding threshold (Yes in step S9), it is possible to generate suitable second pattern data based on the image density fluctuation. The controller 110 sets the flag A, determines the execution of the first fluctuation control and the second fluctuation control (step S10) and generates the second pattern data for photoconductor cycle and the one for sleeve cycle based on the image density fluctuation detected in the second detection process, that is, executes the second pattern data generation process (step S11).

Next, the controller 110 that generates the second pattern data executes the third detection process to detect the image density fluctuation of the third test image (step S12). Subsequently, the controller 110 determines whether either the variations σ1 or the variations σ2 in the image density fluctuation detected in the third detection process is smaller than the corresponding threshold (step S13). When either the variations σ1 or the variations σ2 is equal to or greater than the corresponding threshold (No in step S13), the third fluctuation control based on the third pattern data generated from the image density fluctuation with the great variation may increase the residual cyclic fluctuation. Therefore, in such a case, the controller 110 resets the flag B (step S8) and terminates the sequential process flow. In this case, the controller 110 executes only two processes, that is, the first fluctuation control and the second fluctuation control out of above described three fluctuation controls in the subsequent image forming process. Not executing the third fluctuation control avoids the increase of the residual cyclic fluctuation caused by the execution of the third fluctuation control using unsuitable third pattern data.

On the other hand, when the variations σ1 and σ2 in the image density fluctuation of the third test image is less than the corresponding threshold (Yes in step S13), it is possible to generate suitable third pattern data based on the image density fluctuation. The controller 110 sets the flag B, determines the execution of the third fluctuation control (step S14), and executes the third pattern data generation process (step S15) to generate the third pattern data for photoconductor cycle and the one for sleeve cycle. After that, the controller 110 terminates the sequential process flow.

In the regular adjustment control described above, a set of steps S4, S7, S8, S9, S10, S13, and S14 functions as the determination process. When the controller 110 determines not to execute the first fluctuation control (No in step S4) in the determination process, the controller 110 terminates the sequential process flow as follows. That is, as illustrated in FIG. 19, not executing the first pattern data generation process (step S5), the second detection process (step S6), the second pattern data generation process (step S11), the third detection process (step S12), and the third pattern data generation process (step S15), the controller 110 terminates the sequential process flow. This means that the controller 110 executes the subsequent image forming process without executing the above processes.

When not executing the first fluctuation control, the controller 110 does not execute the second fluctuation control and the third fluctuation control. Thus, generation of three types of pattern data, that is, the first, second, and third pattern data is not needed. Therefore, when the controller 110 determines not to execute the first fluctuation control (No in step S4), the controller 110 skips the first pattern data generation process (step S5), the second detection process (step S6), the second pattern data generation process (step S11), the third detection process (step S12), and the third pattern data generation process (step S15), and terminates the sequential process flow. Such control avoids downtime, energy consumption, and toner consumption caused by unnecessary execution of the above processes.

When the controller 110 determines not to execute the second fluctuation control (No in step S9) in the regular adjustment control, the controller 110 skips the second pattern data generation process (step S11), the third detection process (step S12), and the third pattern data generation process (step S15), and terminates the sequential process flow. Such control avoids downtime, energy consumption, and toner consumption caused by unnecessary execution of the above processes.

When the controller 110 determines not to execute the third fluctuation control (No in step S13) in the regular adjustment control, the controller 110 skips the third pattern data generation process (step S15), and terminates the sequential process flow. Such process avoids downtime, energy consumption caused by unnecessary execution of the third pattern data generation process.

Figure 20:
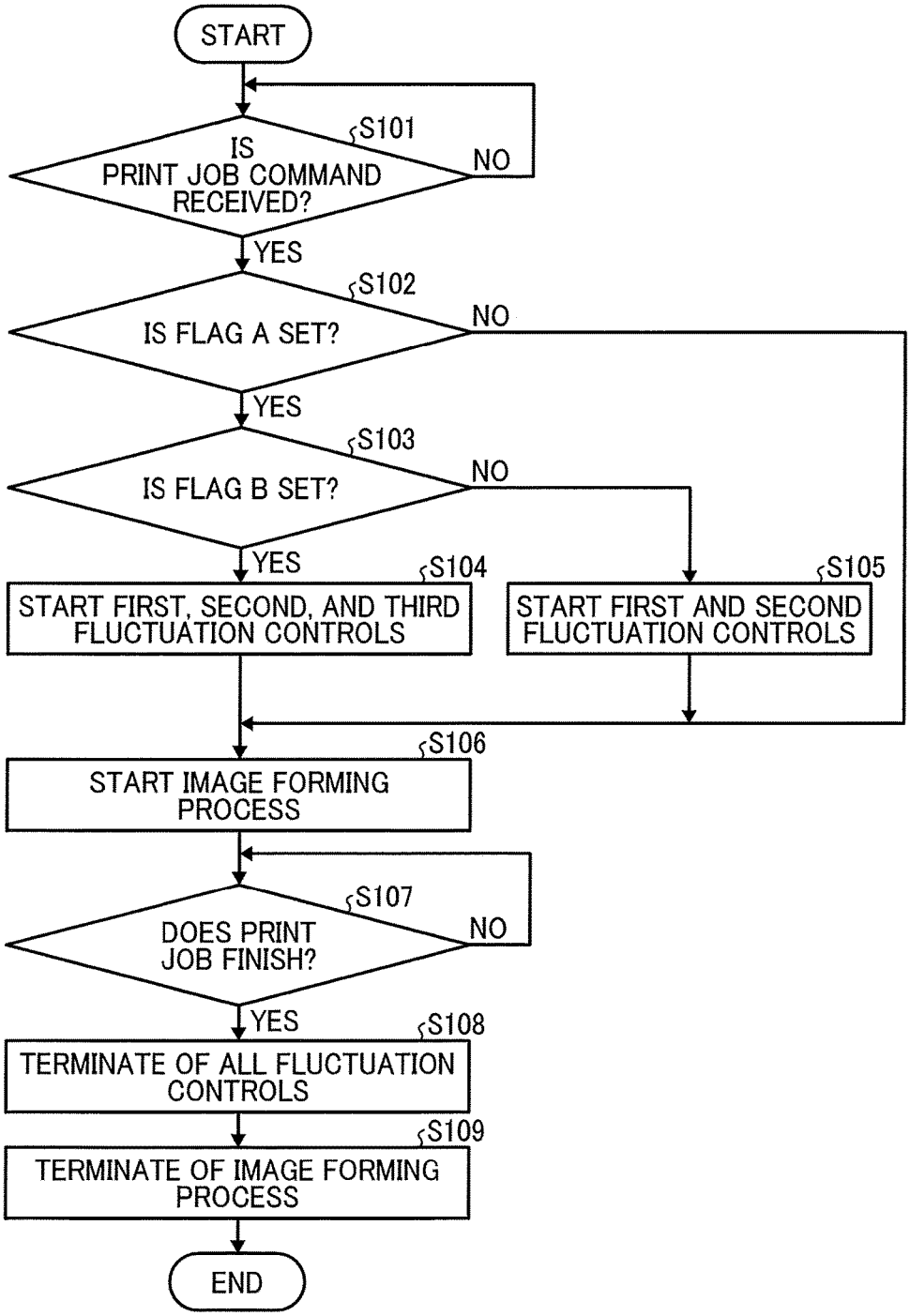
FIG. 20 is a flowchart illustrating steps in a process of a print job control performed by the controller of the copier.

FIG. 20 is a flowchart illustrating steps in a process of a print job control performed by the controller 110. In this process flow, when the controller 110 receives a print job command (Yes in step S101), the controller 110 determines whether the flag A is set (step S102). When the flag A is not set (No in step S102), the controller 110 skips the first fluctuation control, the second fluctuation control, and the third fluctuation control, starts the image forming process (step S106), and executes a print job relating to the print job command. After the print job finishes (Yes in step S107), the controller 110 terminates the image forming process (step S109). In FIG. 20, prior to step S109, a step in which all the fluctuation control (e.g., the first to third fluctuation controls) are terminated is illustrated (step S108), but, because the controller 110 executes the image forming process without executing all the fluctuation control when the flag A is not set (No in step S102), the controller 110 does not execute step S108 substantially.

On the other hand, when the flag A is set (Yes in step S102), the controller 110 determines whether the flag B is set (step S103). When the flag B is set (Yes in step S103), the controller 110 starts the first fluctuation control, the second fluctuation control, and the third fluctuation control (step S104). After that, the controller 110 starts the image forming process (step S106). Thus, while each of the developing bias, the charging bias, and the LD power is changed cyclically, an image based on the user's command is formed.

When the flag B is not set (No in step S103), the controller 110 starts only the first fluctuation control and the second fluctuation control of the three fluctuation controls (step S105). After that, the controller 110 starts the image forming process (step S106). Thus, while each of the developing bias and the charging bias of the three image forming conditions is changed cyclically, the image based on the user's command is formed.

Above described example relates to the determination of the execution of the first fluctuation control based on the variations σ1 and σ2 in the image density fluctuation of the first test image, but the controller 110 may execute the following determination process. That is, when the controller 110 forms a solid test toner image while executing only the first fluctuation control, of the three fluctuation controls, according to the first pattern data generated based on the image density fluctuation with the big variations σ1 and σ2, generally, an image density fluctuation of the solid test toner image has the big variations σ1 and σ2. Therefore, after the first detection process, the controller 110 may form the solid test toner image while executing the first fluctuation control, calculate the variations σ1 and σ2 in the image density fluctuation of the solid test toner image, and determine whether the controller 110 executes the first fluctuation control based on the calculated variations σ1 and σ2. In this control, when either the variations σ1 or the variations σ2 is bigger than predetermined values, the controller 110 skips the second detection process, the second pattern data generation process, the third detection process, and the third pattern data generation process, and terminates the regular adjustment control. Such control avoids downtime, energy consumption, and toner consumption caused by unnecessary execution of the above processes.

Also, above described example relates to the determination of the execution of the second fluctuation control based on the variations σ1 and σ2 in the image density fluctuation of the second test image, but the controller 110 may execute the following determination process. That is, the controller 110 forms a halftone test toner image while executing the first and second fluctuation controls according to the second pattern data generated based on the image density fluctuation with the big variations σ1 and σ2. Generally, an image density fluctuation of such a halftone test toner image has big variations σ1 and σ2. Therefore, after the second detection process, the controller 110 may form the halftone test toner image while executing the first and second fluctuation controls, calculate the variations σ1 and σ2 in the image density fluctuation of the halftone test toner image, and determine whether the controller 110 executes the second fluctuation control based on the calculated variations σ1 and σ2. In this control, when either the variations σ1 or the variations σ2 is bigger than a predetermined value, the controller 110 skips the third detection process, and the third pattern data generation process, and terminates the regular adjustment control. Such control avoids downtime and energy consumption caused by unnecessary execution of the third pattern data generation process.

Also, above described example relates to the determination of the execution of the third fluctuation control based on the variations σ1 and σ2 in the image density fluctuation of the third test image. Alternatively, the controller 110 may form the solid test toner image while executing the first, second, and third fluctuation control, calculates the variations σ1 and σ2 in the image density fluctuation of the solid test toner image, and determine not executing the third fluctuation control when the calculated variations σ1 and σ2 are bigger than predetermined values, respectively.

When a resistance unevenness is in the circumferential direction on a charging roller (for example, the charging roller 71Y), even if the charging roller charges a photoconductor (e.g., the photoconductor 20Y) with the constant charging bias, uneven charging of the photoconductor due to the resistance unevenness occurs. Due to the uneven charging, a cyclic image density fluctuation occurs in a halftone portion of a print image. Therefore, the charging bias may be changed cyclically based not only on the second pattern data but also on a fourth pattern data.

Specifically, the charging roller is provided with a charging roller rotation sensor to detect the charging roller being in the predetermined rotation attitude. While the charging roller is applied with a predetermined constant charging bias, a fourth test image is formed. Based on the fourth test image, the cyclic image density fluctuation caused by the resistance unevenness on the charging roller is detected. The controller 110 generates fourth pattern data as a charging bias pattern to offset the cyclic image density fluctuation based on the detected result. In the second fluctuation control, the following three types of charging bias output difference are superimposed and controlled as the charging bias output. The first type of the charging bias output difference is determined based on the second pattern data for photoconductor cycle and the photoconductor reference attitude timing. The second type of the charging bias output difference is determined based on the second pattern data for sleeve cycle and the sleeve reference attitude timing. The third type of the charging bias output difference is determined based on the fourth pattern data and a charging roller reference attitude timing.

Example

Next, a description is given of an example in which a more specific configuration is applied to the copier according to the embodiment. Unless the difference is described below, the configuration of the copier according to the examples is similar to the one according to the above-described embodiment. In the example, it is explained that various types of pattern data are generated by a method different from the embodiment. By using the method, the copier 500 according to the embodiment may generate the various types of pattern data.

The copier according to the example performs frequency analysis on an average waveform averaged waveforms of a plurality of cycles illustrated in FIG. 14. A frequency analysis method may be a Fast Fourier Transform (FFT) method or an orthogonal waveform detection process. The copier of the example uses the orthogonal waveform detection process, superimposes sine waves like the following equation, and expresses the average waveform.

$$f(t)=A1\times\sin(\omega t+\theta 1)+A2\times\sin(2^*t+\theta 2)+A3\times\sin(3^*\omega t+\theta 3)+A4\times\sin(4^*\omega t+\theta 4)+\ldots A20\times\sin(20^*\omega t+\theta 20)$$

In the above equation, i is a natural number from 1 to 20; f (t) is the average waveform of cutout waveforms of fluctuations in toner adhesion amount [$10^{-3}$ mg/cm$^2$]; Ai is an amplitude of sine wave [$10^{-3}$ mg/cm$^2$]; ω is an angular speed of a rotating body (the sleeve or the photoconductor) [rad/s]; and θi is a phase of the sine wave [rad].

Instead of the above described equation, the following equation may be used, $$f(t)=\Sigma Ai\times\sin(i\times C\omega t+\theta i)$$

The above equation is determined for the photoconductor cycle. Based on a conversion equation given by experiments, the amplitude Ai in the above equation is converted to a developing bias difference. Assigning the converted developing bias difference to the above equation leads to the first pattern data for the photoconductor cycle. Specifically, the following equation gives the first pattern data for the photoconductor cycle.

$$f(t)=\Sigma\text{bias amplitude}\times\sin(I\times\omega(t-t1)+\theta i)$$

In the above equation, t1 means a delay time given by a layout distance between a position which the test image is detected and a position which the test image is developed. The t1 is calculated from the layout distance and a process speed. Considering the delay time t1 makes possible to compensate for affection of the layout distance. The first pattern data for the photoconductor is calculated from t=0 to t=one photoconductor rotation cycle.

The first pattern data for sleeve cycle is calculated similarly by using the above equations.

Similar calculation method generates the second pattern data for photoconductor cycle, the second pattern data for sleeve cycle, the third pattern data for photoconductor cycle, and the third pattern data for sleeve cycle.

Figure 21:
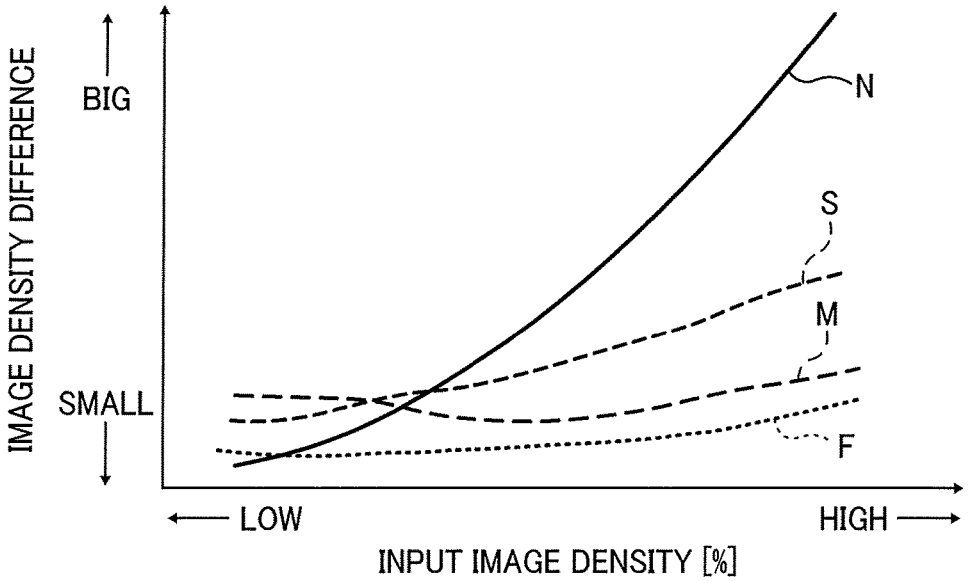
FIG. 21 is a graph illustrating relations between an input image density (an image density expressed by image data) and difference between an output image density and the input image density in some cases characterized by a combination of some fluctuation controls.

FIG. 21 is a graph illustrating relations between an input image density (an image density expressed by image data) and an image density difference between an output image density and the input image density in some cases characterized by a combination of some fluctuation controls. In FIG. 21, a dotted line marked "F" illustrates a characteristics of the case in which all the fluctuation controls, that is, the first fluctuation control, the second fluctuation control, and the third fluctuation control are executed. This case is called the first condition hereinafter. The case in which only the first fluctuation control and the second fluctuation control are executed is called the second condition.

Any of four characteristics in FIG. 21 has a tendency that the image density difference becomes bigger at higher input image density. In the solid portion whose image density becomes biggest, the image density difference becomes biggest. Hereinafter, the image density difference of the solid portion is called a solid image density difference. When the solid image density difference and the combination of some fluctuation controls are focused, the solid image density difference becomes biggest in the case that the first fluctuation control, the second fluctuation control, and the third fluctuation are not executed. In the first condition in which all of the first fluctuation control, the second fluctuation control, and the third fluctuation are executed, the solid image density difference becomes smallest.

The first pattern data to change the developing bias cyclically is generated to produce bias cyclical fluctuation with a relatively big amplitude in order to suppress cyclical image density fluctuation of the high image density of the solid portion effectively. This results in a relatively big amplitude of the cyclic fluctuation of the background potential caused by the cyclic fluctuation of the developing bias. Therefore, the second pattern data to change the charging bias cyclically is generated to produce a bias cyclical fluctuation with a relatively big amplitude. When the third fluctuation control based on the third pattern data is not executed, the relatively big amplitude of the cyclic fluctuation of the developing potential caused by the cyclic change of the charging bias results in a relatively big image density difference of the solid portion having the high image density. When the controller 110 uses a set of the first pattern data and the second pattern data, which is generated under assumption of the first condition that means execution of all fluctuation controls, that is, the first to third fluctuation controls, but employs the second condition that means executing only the first fluctuation control and the second fluctuation control, the image density difference of the solid portion becomes relatively bigger. A dashed line marked "S" in FIG. 21 illustrates above described situation. Hereinafter, the first pattern data and the second pattern data, which are generated under assumption of the first condition that means execution of all fluctuation control, are called the first pattern data for the first condition and the second pattern data for the first condition.

A description is provided of an experiment indicating that using the following set of the first modified pattern data and the second modified pattern data for the second condition makes it possible to decrease an image density difference of the solid portion in the second condition. The set of the first modified pattern data and the second modified pattern data for the second condition generates a smaller amplitude of the cyclic fluctuation of bias than the one based on the first condition. A dashed spaced line marked "M" in FIG. 21 illustrates a relation between the input image density and the image density difference in the second condition using the above described set of the first modified pattern data and the second modified pattern data for the second condition. As illustrated in FIG. 21, the image density difference of the high image density portion of the line "M" is smaller than that of the line "S". That is, using the set of the first modified pattern data and the second modified pattern data for the second condition makes the image density difference of the high image density portion smaller.

Based on the above data, the controller 110 of the copier 500 according to the embodiment generates the first modified pattern data for the second condition that is given by multiplying a predetermined gain by each of the first pattern data for the first condition after generating the first pattern data for the first condition in the first pattern data generation process. Similarly, in the second pattern data generation process, the controller 110 generates the second modified pattern data for the second condition that is given by multiplying a predetermined gain by each of the second pattern data for the first condition after generating the second pattern data for the first condition. When the controller 110 employs the first condition, the controller 110 cyclically changes the developing bias using the first pattern data for the first condition in the first fluctuation control and cyclically changes the charging bias using the second pattern data for the first condition in the second fluctuation control. On the other hand, when the controller 110 employs the second condition, the controller 110 cyclically changes the developing bias using the first modified pattern data for the second condition in a first modified fluctuation control and cyclically changes the charging bias using the second modified pattern data for the second condition in a second modified fluctuation control.

Figure 22:
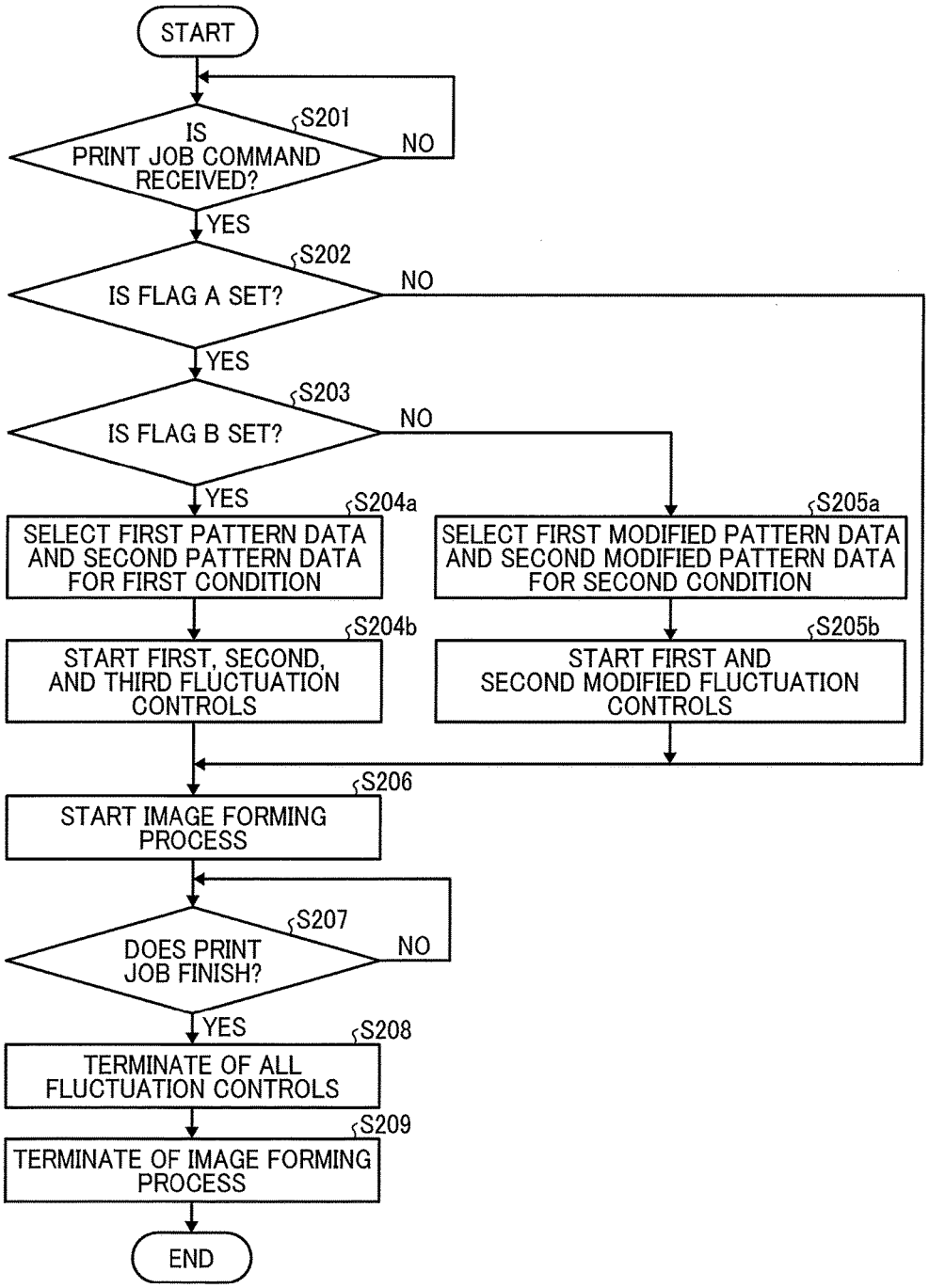
FIG. 22 is a flowchart illustrating steps in a process of a print job control performed by the controller of the copier according to an embodiment.

FIG. 22 is a flowchart illustrating steps in a process of a print job control performed by the controller 110 of the copier 500 according to the embodiment. In FIG. 22, the steps other than steps S204*a*, S204*b*, S205*a* and S205*b* are the same as the steps other than steps S104 and S105 in FIG. 20, and therefore, the explanation thereof is omitted.

When the flag B is set (Yes in step S203), the controller 110 selects the first pattern data and the second pattern data for the first condition (step S204*a*). After that, the controller 110 starts the first fluctuation control, the second fluctuation control, and the third fluctuation control (step S204*b*), that is, execution of the first condition. On the other hand, when the flag B is not set (No in step S203), the controller 110 selects the first modified pattern data and the second modified pattern data for the second condition (step S205*a*). After that, the controller 110 starts the first modified fluctuation control and the second modified fluctuation control (step S205*b*), that is, execution of the second condition.

In the above-described control, compared with the case that executes the second condition using the first pattern data and the second pattern data for the first condition, the image density difference of the solid portion becomes smaller.

The present disclosure is not limited to the foregoing embodiments, but a variety of modifications can naturally be made within the scope of the present disclosure. For example, the present disclosure also includes aspects having the following advantages.

Aspect A

In aspect A, an image forming apparatus includes an image forming unit (e.g., a combination of the image forming unit 18 and the laser writing device 21) to form a toner image that includes a latent image bearer (e.g., the photoconductor 20) to bear a latent image, a charger (e.g., charging device 70) to charge a surface of the latent image bearer, an exposure device (e.g., the laser writing device 21) to expose the latent image on the charged surface of the latent image bearer, and a developing device (e.g., the developing device 80) to develop the latent image with a developer, and a controller (e.g., the controller 110) to execute an image forming process by the image forming unit, a first fluctuation control that cyclically changes a developing bias supplied to the developing device based on predetermined first pattern data in parallel with the image forming process, and a second fluctuation control that cyclically changes a charging bias supplied to the charger based on predetermined second pattern data in parallel with the image forming process, and execute a determination process determining whether the controller executes the first fluctuation control and the image forming process in parallel. In the determination process, the controller determines not to execute the second fluctuation control and the image forming process in parallel when the controller determines not to execute the first fluctuation control and the image forming process in parallel.

In the aspect A, the first fluctuation control that cyclically changes the developing bias suppresses the cyclical image density fluctuation of the solid portion. The second fluctuation control that cyclically changes the charging bias suppresses the cyclical variation of the background potential due to the cyclical change of the developing bias in the first fluctuation control, and the cyclical image density fluctuation of the halftone portion caused by the cyclical variation of the background potential.

Additionally, the aspect A makes it possible to avoid deterioration of a cyclical image density fluctuation of the solid portion and the halftone portion caused by cyclically changing only the charging bias in parallel with the image forming process because of the following reason. That is, not executing the first fluctuation control means not occurring the cyclical variation of the background potential due to the cyclical change of the developing bias in the first fluctuation control. Therefore, the cyclical image density fluctuation of the halftone portion caused by the cyclical variation of the background potential does not occur. In spite of the above, cyclically changing the charging bias in the execution of the second fluctuation control causes the cyclical variation of the background potential because cyclically changing the charging bias bring about the cyclical variation of a charged potential of the latent image bearer under a constant developing bias. Because of the cyclical variation of the background potential, the cyclical image density fluctuation of the halftone portion is worsened. Therefore, in the aspect A, the controller determines not to execute the second fluctuation control when the controller determines not to execute the first fluctuation control in the determination process. This makes it possible to avoid deterioration of a cyclical image density fluctuation of the halftone portion caused by cyclically changing only the charging bias of the charging bias and the developing bias in parallel with the image forming process.

Aspect B

In aspect B, the controller of the image forming apparatus according to the aspect A executes, a third fluctuation control that cyclically changes a writing power of the exposure device based on predetermined third pattern data in parallel with the image forming process in addition to the first fluctuation control and the second fluctuation control, and, in the determination process, determines not to execute the second fluctuation control and the third fluctuation control when the controller determines not to execute the first fluctuation control. Executing the third fluctuation control in the above controller decrease an image density cyclic fluctuation in the solid portion caused by executing the second fluctuation control.

Aspect C

In aspect C, the image forming apparatus according to the aspect A includes a detector (e.g., an optical sensor unit 150) to detect an image density fluctuation of a first test image and a second test image formed by the image forming unit, and the controller to execute, based on a result of the determination process, at least one of a first detection process in which the detector detects an image density fluctuation of the first test image formed by the image forming unit without cyclically changing the developing bias and the charging bias, a first pattern data generation process to generate the first pattern data based on a result detected in the first detection process, a second detection process in which the detector detects the image density fluctuation of the second test image formed by the image forming unit while the controller cyclically changes the developing bias based on the first pattern data generated by the first pattern data generation process, and a second pattern data generation process to generate the second pattern data based on a result detected in the second detection process. In the determination process, the controller determines whether the controller executes the first fluctuation control based on at least one of the result detected in the first detection process and a result detected by the detector that detects an image density fluctuation of a toner image formed by the image forming unit executing under the first fluctuation control. The controller described above regularly executes the first detection process, the first pattern data generation process, the second detection process, and the second pattern data generation process and updates the first pattern data and the second pattern data. Therefore, the controller prevents the pattern data from becoming unsuitable by an environmental change and decreases an image density cyclic fluctuation in the solid portion and the halftone portion. Furtherly the controller determines whether the first pattern data is suitable based on at least one of the result detected in the first detection process and the result detected by the detector that detects the image density fluctuation of the toner image formed by the image forming unit executing only the first fluctuation control.

Aspect D

In aspect D, the controller of the image forming apparatus according to the aspect C determines whether the controller executes the first fluctuation control based on the result detected in the first detection process in the determination process. After the controller determines not to execute the first fluctuation control, the controller executes the image forming process without executing the first pattern data process, the second detection process, and the second pattern data generation process. The controller described above avoids downtime, energy consumption, and toner consumption caused by unnecessary execution of the first pattern data process, the second detection process, and the second pattern data generation process.

Aspect E

In aspect E, the controller of the image forming apparatus according to the aspect C determines whether the controller executes the first fluctuation control based on the result detected by the detector that detects the image density fluctuation of the toner image formed by the image forming unit under the first fluctuation control in the determination process. After the controller determines not to execute the first fluctuation control, the controller executes the image forming process without executing the second detection process and the second pattern data generation process. The controller described above avoids downtime, energy consumption, and toner consumption caused by unnecessary execution of the second detection process, and the second pattern data generation process.

Aspect F

In aspect F, the image forming apparatus according to the aspect B includes a detector (e.g., an optical sensor unit 150) to detect an image density fluctuation of a first test image, a second test image, and a third test image formed by the image forming unit, and the controller to execute based on a result of the determination process, at least one of a first detection process in which the detector detects an image density fluctuation of the first test image formed by the image forming unit without cyclically changing the developing bias and the charging bias, a first pattern data generation process to generate the first pattern data based on a result detected in the first detection process, a second detection process in which the detector detects the image density fluctuation of the second test image formed by the image forming unit while the controller cyclically changes the developing bias based on the first pattern data generated by the first pattern data generation process, and a second pattern data generation process to generate the second pattern data based on a result detected in the second detection process, a third detection process in which the detector detects the image density fluctuation of the third test image formed by the image forming unit while the image forming unit cyclically changes the developing bias based on the first pattern data and the charging bias based on the second pattern data, a third pattern data generation process to generate third pattern data based on a result detected in the third detection process. The controller determines whether the controller executes the first fluctuation control based on at least one of the result detected in the first detection process and a result detected by the detector that detects an image density fluctuation of a toner image formed by the image forming unit executing the first fluctuation control in the determination process. The controller described above regularly executes the first detection process, the first pattern data generation process, the second detection process, the second pattern data generation process, the third detection process, and the third pattern data generation process and updates the first pattern data, the second pattern data, and the third pattern data. Therefore, the controller enables the following things. That is, the controller prevents the pattern data from becoming unsuitable by an environmental change and decreases an image density cyclic fluctuation in the solid portion and the halftone portion. Furtherly the controller determines whether the first pattern data is suitable based on at least one of the result detected in the first detection process and the result detected by the detector that detects the image density fluctuation of the toner image formed by the image forming unit executing only the first fluctuation control of the first fluctuation control and the second fluctuation control.

Aspect G

In aspect G, the controller of the image forming apparatus according to the aspect F determines whether the controller executes the first fluctuation control based on the result detected in the first detection process in the determination process. After the controller determines not to execute the first fluctuation control, the controller executes the image forming process without executing the first pattern data process, the second detection process, the second pattern data generation process, the third detection process, and the third pattern data generation process. The controller described above avoids downtime, energy consumption, and toner consumption caused by unnecessary execution of the first pattern data process, the second detection process, the second pattern data generation process, the third detection process, and the third pattern data generation process.

Aspect H

In aspect H, the controller of the image forming apparatus according to the aspect F determines whether the controller executes the first fluctuation control based on the result detected by the detector that detects the image density fluctuation of the toner image formed by the image forming unit executing only the first fluctuation control in the determination process. After the controller determines not to execute the first fluctuation control, the controller executes the image forming process without executing the second detection process, the second pattern data generation process, the third detection process, and the third pattern data generation process. The controller described above avoids downtime, energy consumption, and toner consumption caused by unnecessary execution of the second detection process, the second pattern data generation process, the third detection process, and the third pattern data generation process.

Aspect I

In aspect I, the controller of the image forming apparatus according to the aspect F determines not to execute the first fluctuation control and the third fluctuation control when the controller determines not to execute the second fluctuation control in the determination process. The controller described above avoids an increase of the image density cyclic fluctuation in the solid portion and the halftone portion caused by executing the first fluctuation control and the third fluctuation control in spite of not executing the second fluctuation control.

Aspect J

In aspect J, the controller of the image forming apparatus according to the aspect I determines whether the controller executes the second fluctuation control based on the result detected in the second detection process in the determination process. After the controller determines not to execute the second fluctuation control, the controller executes the image forming process without executing the second pattern data generation process, the third detection process, and the third pattern data generation process. The controller described above avoids downtime, energy consumption, and toner consumption caused by unnecessary execution of the second pattern data generation process, the third detection process, and the third pattern data generation process.

Aspect K

In aspect K, the controller of the image forming apparatus according to the aspect I determines whether the controller executes the second fluctuation control based on the result detected by the detector that detects the image density fluctuation of the toner image formed by the image forming unit executing the first fluctuation control and the second fluctuation control in the determination process. After the controller determines not to execute the second fluctuation control, the controller executes the image forming process without executing the third detection process and the third pattern data generation process. The controller described above avoids downtime, energy consumption, and toner consumption caused by unnecessary execution of the third detection process, and the third pattern data generation process.

Aspect L

In aspect L, the controller of the image forming apparatus according to any one of Aspects F through K, determines whether the controller executes the third fluctuation control based on at least one of the result detected in the third detection process and a result detected by the detector that detects an image density fluctuation of a toner image formed by the image forming unit executing the first fluctuation control, the second fluctuation control, and the third fluctuation control in the determination process. The controller executes the image forming process in parallel with the first fluctuation control and the second fluctuation control, when the controller determines not to execute the third fluctuation control in the determination process. The controller described above determines whether the third pattern data is suitable based on at least one of the result detected in the third detection process and the result detected by the detector that detects the image density fluctuation of the toner image formed by the image forming unit executing the first fluctuation control, the second fluctuation control and the third fluctuation control. Even if the controller does not execute the third fluctuation control because the third pattern data is unsuitable, executing the first fluctuation control and the second fluctuation control decreases the image density cyclic fluctuation in the solid portion and the halftone portion.

Aspect M

In aspect M, the controller of the image forming apparatus according to the aspect L generates, in the first pattern data generation process, the first pattern data corresponding to a first condition in which the controller executes the three fluctuation control, that is, the first fluctuation control, the second fluctuation control, and the third fluctuation control, and first modified pattern data corresponding to a second condition in which the controller executes only the first fluctuation control and the second fluctuation control. The controller generates, in the second pattern data generation process, the second pattern data corresponding to the first condition and second modified pattern data corresponding to the second condition. The controller described above generates the first pattern data suitable for the first condition, the first modified pattern data suitable for the second condition, the second pattern data suitable for the first condition, and the second modified pattern data suitable for second condition.

Aspect N

In aspect N, the controller of the image forming apparatus according to the aspect M, when the controller determines to execute the third fluctuation control in the determination process, cyclically changes the developing bias based on the first pattern data corresponding to the first condition in the first fluctuation control and the charging bias based on the second pattern data corresponding to the first condition in the second fluctuation control. When the controller determines not to execute the third fluctuation control in the determination process, the controller cyclically changes the developing bias based on the first modified pattern data corresponding to the second condition in a first modified fluctuation control and the charging bias based on the second modified pattern data corresponding to the second condition in a second modified fluctuation control. Compared with the case using the first pattern data and the second pattern data corresponding to the first condition under the second condition, the controller described above suppress the image density cyclic fluctuation in the solid portion.

Aspect O

In aspect O, the controller of the image forming apparatus according to the aspect N generates, in the first pattern data generation process, the first modified pattern data corresponding to the second condition by a calculation of the first pattern data corresponding to the first condition. The controller described above generates the first modified pattern data suitable for the second condition by simple process that is the calculation from the first pattern data corresponding to the first condition.

Aspect P

In aspect P, the controller of the image forming apparatus according to the aspect N generates, in the second pattern data generation process, the second modified pattern data corresponding to the second condition by a calculation of the second pattern data corresponding to the first condition. For example, the controller may multiply gain and the second pattern data corresponding to the first condition. The controller described above generates the second modified pattern data suitable for the second condition by simple process that is a calculation from the second pattern data corresponding to the first condition.

Aspect Q

In aspect Q, the controller of the image forming apparatus according to any one of Aspects F through P, generates pattern data that cyclically changes in a rotational period of the latent image bearer as each of the first pattern data, the second pattern data, and the third pattern data. The controller described above suppress the image density cyclic fluctuation in the solid portion and the halftone portion whose rotational period is the rotational period of the latent image bearer.

Aspect R

In aspect R, the image forming apparatus according to any one of Aspects F through Q, includes the developing device including a developing roller and the controller to generate pattern data that cyclically changes in a rotational period of the developing roller as each of the first pattern data, the second pattern data, and the third pattern data. The controller described above suppress the image density cyclic fluctuation in the solid portion and the halftone portion whose rotational period is the rotational period of the developing roller.

Aspect S

In aspect S, the image forming apparatus according to any one of Aspects F through R, includes the charger including a charging roller and the controller to generate pattern data that cyclically changes in a rotational period of the charging roller as each of the first pattern data, the second pattern data, and the third pattern data. The controller described above suppress the image density cyclic fluctuation in the solid portion and the halftone portion whose rotational period is the rotational period of the charging roller.

Aspect T

An image forming apparatus in aspect T includes an image forming device to form a toner image; and a controller to execute an image forming process in which the image forming device forms the toner image, a first fluctuation control that cyclically changes a first image forming condition (such as a developing bias) of the image forming device based on first pattern data, a second fluctuation control that cyclically changes a second image forming condition (such as a charging bias) of the image forming device based on second pattern data, a third fluctuation control that cyclically changes a third image forming condition (such as a LD power) of the image forming device based on third pattern data, and a determination process to determine whether the controller executes at least one of the first fluctuation control, the second fluctuation control, and the third fluctuation control based on at least one of the first pattern data, the second pattern data, and the third pattern data. When the controller determines not to execute the first fluctuation control in the determination process, the controller does not execute the first fluctuation control, the second fluctuation control, and the third fluctuation control in parallel with the image forming process. Additionally, when the controller determines not to execute only the third fluctuation control in the determination process, the controller executes the image forming process in parallel with a first modified fluctuation control and a second modified fluctuation control. The first modified fluctuation control cyclically changes the first image forming condition based on first modified pattern data corresponding to a second condition that cyclically changes only the first image forming condition and the second image forming condition instead of the first pattern data corresponding to a first condition that cyclically change the first image forming condition, the second image forming condition, and the third image forming condition. The second modified fluctuation control cyclically changes the second image forming condition based on a second modified pattern data corresponding to the second condition instead of the second pattern data corresponding to the first condition.

What is claimed is:

1. An image forming apparatus comprising:

an image forming unit including:

a latent image bearer to bear a latent image;

a charger to charge a surface of the latent image bearer;

an exposure device to expose the latent image on the charged surface of the latent image bearer; and a developing device to develop the latent image with a developer, and a controller to execute an image forming process by the image forming unit, a first fluctuation control that cyclically changes a developing bias supplied to the developing device based on first pattern data in parallel with the image forming process, a second fluctuation control that cyclically changes a charging bias supplied to the charger based on second pattern data in parallel with the image forming process, and a determination process to determine whether the controller executes the first fluctuation control and the image forming process in parallel, the determination process to determine not to execute the second fluctuation control and the image forming process in parallel when the controller determines not to execute the first fluctuation control and the image forming process in parallel, wherein the first pattern data includes one of a solid image and a first half tone image, and wherein the second pattern data includes a second half tone image.

2. The image forming apparatus according to claim 1, wherein the controller executes a third fluctuation control that cyclically changes a writing power of the exposure device based on third pattern data in parallel with the image forming process in addition to the first fluctuation control and the second fluctuation control, and wherein, in the determination process, the controller determines not to execute the second fluctuation control and the third fluctuation control when the controller determines not to execute the first fluctuation control.

3. An image forming apparatus comprising:

an image forming unit including:

a latent image bearer to bear a latent image;

a charger to charge a surface of the latent image bearer;

an exposure device to expose the latent image on the charged surface of the latent image bearer; and a developing device to develop the latent image with a developer, and a controller to execute an image forming process by the image forming unit, a first fluctuation control that cyclically changes a developing bias supplied to the developing device based on first pattern data in parallel with the image forming process, a second fluctuation control that cyclically changes a charging bias supplied to the charger based on second pattern data in parallel with the image forming process, and a determination process to determine whether the controller executes the first fluctuation control and the image forming process in parallel, the determination process to determine not to execute the second fluctuation control and the image forming process in parallel when the controller determines not to execute the first fluctuation control and the image forming process in parallel; and a detector to detect an image density fluctuation of a first test image and a second test image formed by the image forming unit, wherein the controller executes, based on a result of the determination process, at least one of a first detection process in which the detector detects the image density fluctuation of the first test image formed without cyclically changing the developing bias and the charging bias, a first pattern data generation process to generate the first pattern data based on a result detected in the first detection process, a second detection process in which the detector detects the image density fluctuation of the second test image formed while the controller cyclically changes the developing bias based on the first pattern data generated by the first pattern data generation process, and a second pattern data generation process to generate the second pattern data based on a result detected in the second detection process, and wherein, in the determination process, the controller determines whether the controller executes the first fluctuation control based on at least one of the result detected in the first detection process and a result detected by the detector that detects an image density fluctuation of a toner image formed by the image forming unit under the first fluctuation control.

4. The image forming apparatus according to claim 3, wherein the controller determines whether the controller executes the first fluctuation control based on the result detected in the first detection process in the determination process, and, wherein, in the determination process, after the controller determines not to execute the first fluctuation control, the controller determines to execute the image forming process without executing the first pattern data generation process, the second detection process, and the second pattern data generation process.

5. The image forming apparatus according to claim 3, wherein the controller determines whether the controller executes the first fluctuation control based on the result detected by the detector that detects the image density fluctuation of the toner image formed by the image forming unit under the first fluctuation control in the determination process, and, wherein, in the determination process, after the controller determines not to execute the first fluctuation control, the controller determines to execute the image forming process without executing the second detection process and the second pattern data generation process.

6. The image forming apparatus according to claim 2, further comprising:

a detector to detect an image density fluctuation of a first test image, a second test image, and a third test image formed by the image forming unit, wherein the controller executes, based on a result of the determination process, at least one of a first detection process in which the detector detects the image density fluctuation of the first test image formed without cyclically changing the developing bias and the charging bias, a first pattern data generation process to generate the first pattern data based on a result detected in the first detection process, a second detection process in which the detector detects the image density fluctuation of the second test image formed while the controller cyclically changes the developing bias based on the first pattern data generated by the first pattern data generation process, and a second pattern data generation process to generate the second pattern data based on a result detected in the second detection process, a third detection process in which the detector detects the image density fluctuation of the third test image formed while the controller cyclically changes the developing bias based on the first pattern data and the charging bias based on the second pattern data, and a third pattern data generation process to generate third pattern data based on a result detected in the third detection process, and wherein, in the determination process, the controller determines whether the controller executes the first fluctuation control based on at least one of the result detected in the first detection process and a result detected by the detector that detects an image density fluctuation of a toner image formed under the first fluctuation control.

7. The image forming apparatus according to claim 6, wherein the controller determines whether the controller executes the first fluctuation control based on the result detected in the first detection process in the determination process, and wherein, in the determination process, after the controller determines not to execute the first fluctuation control, the controller determines to execute the image forming process without executing the first pattern data generation process, the second detection process, the second pattern data generation process, the third detection process, and the third pattern data generation process.

8. The image forming apparatus according to claim 6, wherein the controller determines whether the controller executes the first fluctuation control based on the result detected by the detector that detects the image density fluctuation of the toner image formed by the image forming unit under the first fluctuation control in the determination process, and wherein, in the determination process, after the controller determines not to execute the first fluctuation control, the controller determines to execute the image forming process without executing the second detection process, the second pattern data generation process, the third detection process, and the third pattern data generation process.

9. The image forming apparatus according to claim 6, wherein, in the determination process, the controller determines not to execute the first fluctuation control and the third fluctuation control when the controller determines not to execute the second fluctuation control.

10. The image forming apparatus according to claim 9, wherein the controller determines whether the controller executes the second fluctuation control based on the result detected in the second detection process in the determination process, and wherein, in the determination process, after the controller determines not to execute the second fluctuation control, the controller executes the image forming process without executing the second pattern data generation process, the third detection process, and the third pattern data generation process.

11. The image forming apparatus according to claim 9, wherein the controller determines whether the controller executes the second fluctuation control based on the result detected by the detector that detects the image density fluctuation of the toner image formed by the image forming unit under the first fluctuation control and the second fluctuation control in the determination process, and wherein, in the determination process, after the controller determines not to execute the second fluctuation control, the controller determines to execute the image forming process without executing the third detection process and the third pattern data generation process.

12. The image forming apparatus according to claim 6, wherein the controller determines whether the controller executes the third fluctuation control based on at least one of the result detected in the third detection process and a result detected by the detector that detects an image density fluctuation of a toner image formed by the image forming unit under the first fluctuation control, the second fluctuation control, and the third fluctuation control in the determination process, and wherein the controller executes the image forming process in parallel with the first fluctuation control and the second fluctuation control, when the controller determines not to execute the third fluctuation control in the determination process.

13. The image forming apparatus according to claim 12, wherein the controller generates, in the first pattern data generation process, the first pattern data corresponding to a first condition in which the controller executes all of the first fluctuation control, the second fluctuation control, and the third fluctuation control, and first modified pattern data corresponding to a second condition in which the controller executes the first fluctuation control and the second fluctuation control, and wherein the controller generates, in the second pattern data generation process, the second pattern data corresponding to the first condition and second modified pattern data corresponding to the second condition.

14. The image forming apparatus according to claim 13, wherein when the controller determines to execute the third fluctuation control in the determination process, the controller cyclically changes the developing bias based on the first pattern data corresponding to the first condition in the first fluctuation control and the charging bias based on the second pattern data corresponding to the first condition in the second fluctuation control, and wherein when the controller determines not to execute the third fluctuation control in the determination process, the controller cyclically changes the developing bias based on the first modified pattern data corresponding to the second condition in a first modified fluctuation control and the charging bias based on the second modified pattern data corresponding to the second condition in a second modified fluctuation control.

15. The image forming apparatus according to claim 14, wherein the controller generates, in the first pattern data generation process, the first modified pattern data corresponding to the second condition based on a calculation of the first pattern data corresponding to the first condition.

16. The image forming apparatus according to claim 14, wherein the controller generates, in the second pattern data generation process, the second modified pattern data corresponding to the second condition based on a calculation of the second pattern data corresponding to the first condition.

17. The image forming apparatus according to claim 6, wherein the controller generates pattern data that cyclically changes in a rotational period of the latent image bearer as each of the first pattern data, the second pattern data, and the third pattern data.

18. The image forming apparatus according to claim 6, wherein the developing device includes a developing roller, and wherein the controller generates pattern data that cyclically changes in a rotational period of the developing roller as each of the first pattern data, the second pattern data, and the third pattern data.

19. The image forming apparatus according to claim 6, wherein the charger includes a charging roller, and wherein the controller generates pattern data that cyclically changes in a rotational period of the charging roller as each of the first pattern data, the second pattern data, and the third pattern data.

20. An image forming apparatus comprising:

an image forming device to form a toner image; and a controller to execute an image forming process in which the image forming device forms the toner image, a first fluctuation control that cyclically changes a first image forming condition of the image forming device based on first pattern data, a second fluctuation control that cyclically changes a second image forming condition of the image forming device based on second pattern data, a third fluctuation control that cyclically changes a third image forming condition of the image forming device based on third pattern data, and a determination process to determine whether the controller executes at least one of the first fluctuation control, the second fluctuation control, and the third fluctuation control based on at least one of the first pattern data, the second pattern data, and the third pattern data, the controller not executing the first fluctuation control, the second fluctuation control, and the third fluctuation control in parallel with the image forming process when the controller determines not to execute the first fluctuation control in the determination process, and the controller executing the image forming process in parallel with a first modified fluctuation control and a second modified fluctuation control when the controller determines not to execute the third fluctuation control in the determination process, the first modified fluctuation control to cyclically change the first image forming condition based on first modified pattern data corresponding to a second condition that cyclically changes the first image forming condition and the second image forming condition instead of the first pattern data corresponding to a first condition that cyclically changes the first image forming condition, the second image forming condition, and the third image forming condition, the second modified fluctuation control to cyclically change the second image forming condition based on second modified pattern data corresponding to the second condition instead of the second pattern data corresponding to the first condition.

21. The image forming apparatus according to claim 1, wherein the first pattern data includes the solid image.

22. The image forming apparatus according to claim 1, wherein the first pattern data includes the first half tone image.

* * * * *